US005635693A

United States Patent [19]

Benson et al.

[11] Patent Number: 5,635,693

[45] Date of Patent: Jun. 3, 1997

[54] SYSTEM AND METHOD FOR TRACKING VEHICLES IN VEHICLE LOTS

[75] Inventors: Steven J. Benson, Rochester, Minn.; Thomas A. Cofino, Rye; Robert J. von Gutfeld, New York, both of N.Y.

[73] Assignee: International Business Machines Corporation, Armonk, N.Y.

[21] Appl. No.: 382,747

[22] Filed: Feb. 2, 1995

[51] Int. Cl.[6] ..... G07B 15/02

[52] U.S. Cl. ..... 235/384; 340/825.54

[58] Field of Search ..... 235/384, 389, 235/382.5, 380; 340/825.06, 825.54

[56] References Cited

U.S. PATENT DOCUMENTS

| | | | |
|---|---|---|---|
| 4,075,632 | 2/1978 | Baldwin et al. | 343/6.8 R |
| 4,739,328 | 4/1988 | Koelle et al. | 342/44 |
| 4,786,907 | 11/1988 | Koelle | 342/51 |
| 4,897,642 | 1/1990 | DiLullo et al. | 235/385 X |
| 4,924,221 | 5/1990 | Davies | 340/573 |
| 5,055,659 | 10/1991 | Hendrick et al. | 235/439 |
| 5,142,278 | 8/1992 | Moallemi et al. | 340/825.06 |
| 5,206,643 | 4/1993 | Eckett | 340/932.2 |
| 5,231,273 | 7/1993 | Caswell et al. | 235/385 |
| 5,317,309 | 5/1994 | Vercellotti et al. | 340/825.54 |

FOREIGN PATENT DOCUMENTS

| | | | |
|---|---|---|---|
| 0433740 | 6/1991 | European Pat. Off. | 235/384 |
| 2662285 | 11/1991 | France | 235/384 |

*Primary Examiner*—Donald T. Hajec
*Assistant Examiner*—Thien Minh Le
*Attorney, Agent, or Firm*—Louis J. Percello

[57] ABSTRACT

A radio frequency (RF) tagging system is used to monitor vehicles passing through an area access to one or more vehicle storage area(s). One or more of the vehicles stored in the storage area is equipped with a RF tag which has vehicle ID information about the vehicle stored in a tag memory contained on the tag. The tag communicates with a base station when passing through the area accesses, (entering or leaving). A central and preferably one or more remote computers accesses status information that might include vehicle identification, customer, lot identification, time of day, and vehicle and lot status. The information is used in security or marketing functions. The security function can include a paging system for sending alarms and/or messages to a manager or security personnel. The marketing function can include determining how long or how many times different makes an model of vehicle are chosen by customers for test drives. Additionally, the marketing function will identify past vehicles that were sold at the dealership as an indication of a potential interested buyer.

32 Claims, 19 Drawing Sheets

335

PREDETERMINED TIME DELAY
336
301
338
DEALER SERVICE FILE
READ SERVICE FILE
337
341
RECORD CUSTOMER MKTG TAG RECORD
CUST MKTG TAG FILE FIG.6B
340
VEHICLE IN FOR SVC ?
NO
NEEDS SERVICE
NO
350
342
343
YES
YES
NEEDS SERVICE MESSAGE
ARE THERE TWO CUST MKTG TAG REC
NO
350
343A
344
YES

500

500
DETERMINE INDICATOR
"STOLEN VEHICLE"
"TIMEOUT VIOLATION"
"BILL NOT PAID"
"SERVICE NEEDED"
ETC.
505
510
ASSIGN PAGER TABLE FIG 6D
READ ASSIGNED PAGER TABLE
515
VEHICLE IDENTIFCATION FILE FIG 6A
READ VEHICLE IDENTIFICATION RECORD
525
520
CONSTRUCT PAGER MESSAGE
530
SENT PAGER MESSAGE
540
550
LOG PAGER MESSAGE SENT
LOGGED PAGER FILE FIG 6C
560
570
PROGRAM ENDS

660

ASSIGN PAGER RECORD

| 661 INCIDENT | 662 DESCRIPTION | 663 INDIVIDUAL | 665 PAGER ID | 667 PAGER NUMBER |
|---|---|---|---|---|
| STOLEN VEHICLE | GENERAL MGR | STEVE JONES | 2B123X5 | 507-287-5511 |
| TIMEOUT VIOLATION | SALES MGR | BILL MINER | 2B123X6 | 507-287-5512 |
| SERVICE NOT COMPLETE | SERVICE MGR | TOM BOYD | 2B123X7 | 507-287-5513 |
| OR REQUIRED | ACCOUNTING MGR | MARY LARSON | 2B123X8 | 507-287-5518 |
| BILL NOT PAID | | | | |

FIG.6D

SYSTEM AND METHOD FOR TRACKING VEHICLES IN VEHICLE LOTS

FIELD OF THE INVENTION

This invention relates to the field of automated tracking of moving vehicles entering and leaving lots using radio frequency tagging. More specifically the invention relates to the automation of tracking vehicle inventory, the automation of vehicle theft detection and alarm, the automation of vehicle service monitoring and billing, and the automation of generating specialized marketing reports.

BACKGROUND OF THE INVENTION

There are many applications where it is necessary to collect information regarding when a vehicle enters, leaves, or is stored in a storage area like a vehicle lot. Here the term vehicle includes automobiles, trucks, trailers, rental equipment, snowmobiles, boats or any other class of movable equipment that is parked or stored in an area (lot).

Determining which unique vehicle(s) is on a lot(or lots) continues to be a dilemma for businesses (like a dealership) where there are multiple lots and vehicles routinely moving in and out of the lot (or lots). In the prior art, vehicle status is manually noted in an inventory register, on inventory cards or stored in a computer data base. All these methods arc prone to human error. As the vehicle inventory and number of lots grow, the need for a low cost method automated to track the vehicle inventory grows in importance.

Theft detection is one area where it is necessary to determine if a vehicle has left a storage area (lot) through an access like a driveway during an unauthorized time frame. Specifically, there continues to be a need in automobile dealerships, to automate the process to quickly determine which vehicle left, which lot, and when. This need is particularly important in high crime areas where multiple cars are stolen each month. This function is especially important because many dealers don't make insurance claims because making insurance claims would cause their insurance premium to increase significantly. To complicate matters, the modern dealership has the need to protect their vehicle inventory while trying to encourage prospective customers to visit the dealership 24 hours a day, seven days a week.

At many automobile dealerships several security measures are or have been tried. Some examples of security methods currently in use are:

1. Coded ignition switch—This is an electrical switch which is encoded and connected in series with the standard ignition key switch. This security measure requires the simultaneous entry of a code and the turning of the ignition switch to start a vehicle.
2. Remote camera networks—This is a method of monitoring all the areas around a dealership lot where there is an automobile inventory. These cameras are in fixed locations and require an individual to monitor the camera output displays. Typically the cameras are motorized and can sweep through a specific area in a dealership. At the central monitoring site there is automated or manual switching between several remote cameras to a single (or multiple) monitor(s) where they are viewed.
3. Movement sensors with an alarm—This security measure is individually installed in each automobile which the dealers wish to protect. The sensor when activated is connected to an alarm (often the vehicle horn) which will sound when movement is sensed.

4. Barbed wire fence—This is a very conventional method of protecting the vehicles stored in a lot. In addition to the fence around the perimeter, a lockable gate is required at each driveway entrance to prevent automobiles from being driven off when the lot is closed.
5. Fixed motion sensors—These types of devices sense the movement of, an object and can then be used to turn on an alarm, light, etc. to scare an intruder away.

Each of these prior art methods of providing security against vehicle theft has limitations.

Coded ignition switches are expensive, typically costing $100 per vehicle and require a mechanic 15 to 30 minutes to install or remove the device. They require adaptation to fit into the dash and must be added to the vehicle's cost when the vehicle is sold.

Remote camera networks require an individual to monitor the cameras making them expensive to operate. Additionally, if there are multiple activities an individual can only monitor one camera at a time. Another drawback is cameras require adjustment to keep them in focus enabling a clear view of the license and/or color of an automobile speeding through a driveway.

Movement sensors have the disadvantage that the alarm can be disengaged by disconnecting a vehicles electrical prover (battery). Of course, this type of security doesn't provide a vehicle's identification nor does it allow for the relay of an alarm when a vehicle is stolen from a remote lot. There are of course sophisticated movement sensor activated systems costing hundreds of dollars which solve these problems.

Barbed wire fences have the major drawback of preventing perspective customers access to the dealership when it is closed. This can act as a considerable impediment to vehicle sales given the desire mentioned earlier of wanting customers to shop evenings, holidays and weekends when the dealership isn't officially open. Additionally, a fence can be costly to install and easy for intruders to damage with a cutting pliers.

Fixed motion sensors, while very effective for turning on exterior lighting for customers at night, have the drawback of causing false alarms as a security device. Any object like an animal can cause the motion sensor to activate. Like the fence, this security method doesn't capture the vehicle's identification or the time a particular vehicle is stolen.

Another critical need for people managing vehicles on a lot(s) is monitoring the period of time a vehicle has been off a lot. In the large car dealership example, several hundred vehicles can be taken for test drives each day. During absence from the lot, the vehicle could be broken-down, be in an accident, or be stolen. In any of these cases it would be appropriate to notify the dealer management of a potential problem, the time period the vehicle has been absent and the vehicle's identification. In the prior art, a salesman is required to remember which vehicles left the lot, at what time, and with whom. Dealerships can implement a manual system noting this information on a status board or using small index cards. Most dealers find this type of system is difficult to maintain accurately and timely.

There is also a need to automate the process of gaining marketing information about vehicles on a lot(s) which have been test driven by potential customers. This information might include how many times a vehicle was driven and the total test time on a vehicle. Keeping track of how many times a used vehicle has been driven would be of great value in a used vehicle lot. Typically a used vehicle has unique characteristics, like manufacture, make, model, mileage, color, etc. Prior art methods involve manually marking on a firm which vehicle was taken for a drive. Counting the markings on the form allows the dealer to determine which vehicles are more popular to test drive. The more popular vehicles (a particular model) should be stocked at a higher order rate and will sell for a greater profit.

There is a need to determine which current customers which have purchased a vehicle have returned to a vehicle lot to look at other perspective vehicles. A marketing report would provide a strong indication a current customer is looking for another vehicle. There is no current method known of automating the collection of information, of which current customers have come to a lot, to look at vehicles.

When a vehicle has entered a dealership for service there is a need to know when the vehicle leaves that all the recommended service has been completed. Additional benefit to the dealer is to know as the vehicle leaves that the bill has been paid. There are no known inexpensive methods of automating these checks today.

OBJECTS OF THE INVENTION

An object of this invention is an improved automated system and method to track when vehicles enter, leave or are stored on vehicle storage areas or lot(s) therefore providing real-time a locator indicating which vehicle(s) is (are) in which lot(s).

An object of this invention is an improved automated system and method for identifying theft of vehicles that have left a vehicle storage area (lot) when a vehicle wasn't authorized to leave.

An object of this invention is an improved automated system and method for identifying a vehicle that has been out of a storage area (lots) beyond a predetermined time interval.

An object of this invention is an improved automated system and method for identifying a customer vehicle has left a lot without the completion of vehicle service and/or without paying for the vehicle service.

An object of this invention is an improved automated method for generating marketing reports pertaining to a vehicle(s) movement on and off a vehicle storage area lot(s).

An object of this invention is an improved automated method to determine which customers that have purchased a vehicle have returned to a vehicle lot to shop for another vehicle.

SUMMARY OF THE INVENTION

The present invention is a novel use of radio frequency (RF) tagging to monitor vehicles passing through an area access to a vehicle storage area. Using RF tagging, vehicle information about a vehicle passing through an access area is communicated to a base station/computer system. The base station/computer system has status information that is used with the vehicle information to take a specified action like sending a message to a manager, pager, and/or a computer terminal.

The message can take the form of a security alarm, service report, and/or marketing report.

The vehicle storage area can be a lot like a parking lot at a car dealership and the area access could be a driveway, ramp, etc. allowing vehicles on the lot (storage area) to enter and leave the storage area. The invention can be used with one or more storage areas each having one or more area accesses.

One or more of the vehicles stored in the storage area is equipped with an RF tag which has vehicle information which can include vehicle identification information (ID) and possibly other information like the vehicle service history. The vehicle information is stored in a tag memory contained on the tag. In a preferred embodiment, for automobiles the vehicle ID information is the VIN, Vehicle Identification Number. The RF tag on each vehicle also has a radio receiver and transmitter for receiving and transmitting a radio frequency (RF) signal, a tag antenna for receiving the RF signal and transmitting (or in a preferred embodiment, reflecting) a returned RF signal, and a logic circuit that puts information in the received RF signal to create the returned RE signal.

In a preferred embodiment, one or more base station antennas are located at each of one or more area accesses (entrances/exits) to the storage area. One or more station antennas are electrically connected to each base station. These base station antennas transmit the RF signal generated by the base station to the RF tags on the vehicles/cars passing through (entering or leaving) the area accesses (entrances/exits). The RF tag sends a return RF signal to the base station via the base station antenna. The return RF signal includes the vehicle ID information. In a preferred embodiment multiple antennas connected to a base station can be used to determine direction of vehicle travel.

The invention includes a central computer that can be tied to a remote lot's base station in one of several ways such as: base station to modem, modem to central computer modem; base station to its local controller or concentrator to modem, modem to central computer modem; etc. In the preferred embodiment a remote lot base station is connected to a local computer (which is a remote computer to the central computer) connected to a modem, this modem connects to the central computer modem. One or many base stations capture the entrance/exit number and the vehicle ID information. This information is then relayed to the main computer using any of well known established communications methods. Note that the central computer (storage area) can be at a great distance from the remote computer (remote storage area). For example, the central computer (storage area) can be in one state and the remote computer (storage area) can be in a distant state. In this case, information can be communicated between (among) the central and remote computer(s) via modems or other known communication links (satellite.)

The central computer has status information stored on its disk. The status information might be times that each lot is open/closed, marketing information about the vehicles, customers assigned vehicle storage location information, status of service information about the vehicle, (e.g. the vehicle is a demonstration model or needs an oil change), etc.

In addition to reading the vehicle ID information and the base station information and the entrance/exit number (status information), the central computer can perform additional functions. Using the vehicle ID information, status information, and a system algorithm, the system can determine if a dealer owns a vehicle and that the vehicle is unauthorized to leave the lot, such as a theft. Algorithms can also determine how long a dealer owned vehicle has been on a test drive noting when the test drive has exceeded a preset lot violation time. Using the vehicle ID information a system algorithm can establish, in the case of a customer owned vehicle, whether a dealer has completed the vehicle service and whether the customer has paid the bill for the service as the vehicle leaves the lot. The system can also determine if the vehicle needs service. In each of these cases a message can be sent to a computer terminal indicating the activity that has occurred. In an alternate embodiment, an algorithm further automates each of these processes by sending a page to the appropriate dealership management to initiate action, such as in the case of theft, alert the police. Information about a vehicles absence from the lot can be used as marketing information about the dealer owned vehicle such as total time the vehicle has been test driven or number of times the vehicle has been taken for test drives. Lastly the computer collects information about customers with purchased vehicles returning to a lot with their tagged vehicle. This information can be used to identify current customers that are looking into purchasing another vehicle.

BRIEF DESCRIPTION OF THE DRAWINGS

FIG. 3 comprises FIGS. 3A, 3B, 3C, and 3D.

DETAILED DESCRIPTION OF THE INVENTION

Figure 1:
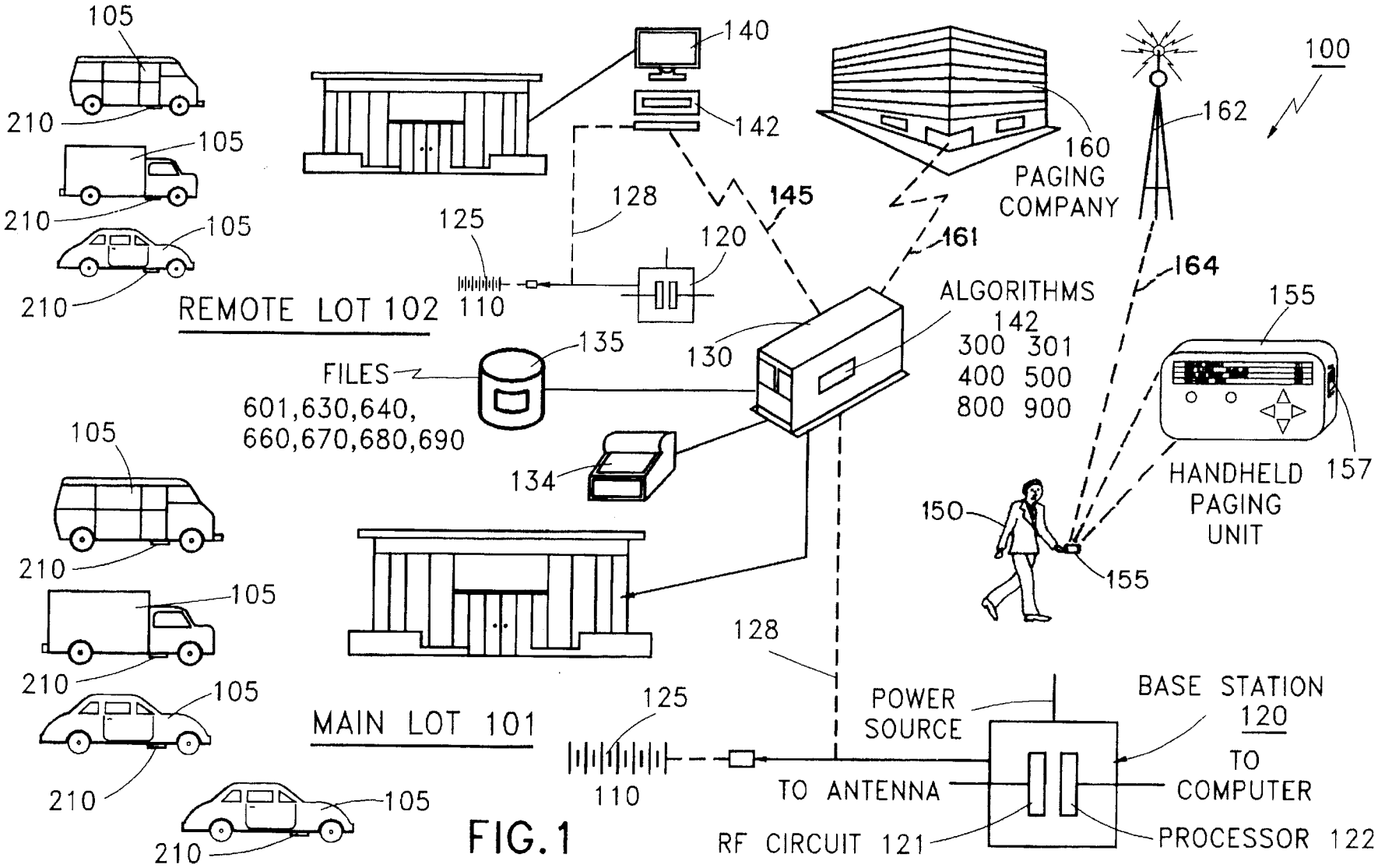
FIG. 1 is a block diagram showing two complete vehicle storage areas (a main lot and a remote lot) with base stations and antennas near the lot entrance(s), a main computer (main lot) with files and printer, a remote computer (remote lot), vehicles with radio frequency tags, a commercial paging company and broadcast antenna, and a manager with a handheld paging unit.

The system (100) comprises of one or more storage areas (101, 102) (e.g. a main lot (101) and, in some preferred embodiments, one or more remote lots (102)), a main computer (130) with algorithms (142, 300, 301, 400, 500, 800, 900), files (135) and a printer (134), a remote computer (140) with algorithms (142), one or more RF tag base stations (120), a paging company (160), with broadcast antenna (162), manager (150) with a handheld pager (155), and one or more vehicles (105) equipped with RF tags (210). In one preferred embodiment there are no remote lots (102).

Each storage area (101, 102) has several vehicles (105) and at least one area access or entrance/exit (110). A vehicle (105) can be any movable mode of transportation including a: car, truck, trailer, boat, railroad car, van, snow mobile, etc. In a preferred embodiment, a vehicle (105) is a car or truck. A storage area (101, 102) is any place where one or mare vehicles (105) is stored. A storage area (101, 102) can include a parking lot (e.g. for a car dealership or for residential or commercial parking), railroad yard, road way, marina, and/or car lot. An area access (110) includes any access to the storage area (101, 102) that permits the vehicle (105) to enter or leave the storage area (101, 102). Area accesses (110) include drive ways, curb cuts, gates, openings, railroad switches, bridges, and canals. In this disclosure, storage areas (101, 102) will be referred to as lots (101, 102) and area accesses (110) will be referred to as entrances (110) and/or exits (110) without the lost of generality.

One or more base station antennas (125) that are electrically connected to a base station (120) are placed in close proximity to one or more of the area accesses or entrances/exits (110). This close proximity is anywhere within the distance that permits an RF signal to be communicated between the base station (120) and the RF tag (210) attached to a vehicle (105) passing through the entrance/exit (110) where the base station antenna (125) is located. Base station antennas (125) are well known as are the methods for mounting them. In some preferred embodiments, the base station antenna (125) is mounted on an independent stand, on a fence in close proximity to the entrance/exit (110), or in the area access (110) e.g. under a driveway or within a speed bump.

A base station (120) is electrically connected to the base station antenna (125). A base station (120) typically includes a base station processor (122) and a radio frequency circuit (121) that is electrically connected to the base station antenna (125). The base station processor (122) typically processes, stores, outputs, and inputs information in the base station (120). Base stations (120)design and connectivity is well known in the RF tagging art.

If there is a remote lot (102), a remote computer (140) may also be included in the system (100). Further a central computer (130) will be included in the system (100). In one preferred embodiment, the base station (120) at the remote lot (102) is connected to the remote computer (140) so that information gathered by the base station (120) can be transferred to the main computer (130) via a communication line (145) or other similar connection. In alternative preferred embodiments, information can be also be gathered at the main computer (130) from base stations (120) or base station processor (122) in the system (100) and/or from one or more remote computers (140). This information can be transferred among the base stations (120), remote computers (140), and the main computer (130) via communication lines (145).

The communication lines (145) could include satellite, phone line, leased line or the like. These communication lines can be used to connect processors/computers (122, 130, 140) at distant locations to one another. The communication lines could also include direct wire connections like a buried cable (128) used for a local connection.

In one preferred embodiment, the main computer (130) is a AS/400 (Trademark of the International Business Machines Corporation) with terminals and printer, with software OS/400, Client Access/400 and PagerPac/400 all described in the publication "AS/400 Advanced Services Handbook" number GA19-5486. The AS/400 is a midrange computer with all the necessary features integrated together. In a preferred embodiment the remote computer (140) can also be an AS/400, or a PC (Personal Computer).

In one preferred embodiment, the remote computer (140) runs an algorithm (142) which reads the field vehicle "Vehicle ID" (602) adds the constant field "Lot Number" (625) and sends the information to the main computer (130). See FIG. 6A and block 307 of FIG. 3. The computer algorithm (142) necessary to read the tag information from the base station is well known to one trained in the art of RF tags.

In a preferred embodiment, the central computer (130) has attached a printer (134) for reports and a disk (135) with files (601, 630, 640, 660, 670, 680, 690) described in FIGS. 6A, 6B, 6C, 6D, 6E, 6F, and 6G. Additionally, the main computer (130) runs algorithms 142, 300, 301, 400, 500, 800 and 900 described below. In one preferred embodiment, the main computer (130) can send alphanumeric pages (157, 640) via communication links (161) similar to communications links (145) described above to a paging company (160) which broadcasts (164) the page over radio frequency by land antenna (162). Several land antennas (162) or satellite (not shown) can be used to increase the area covered by the paging broadcast signal (164). A lot manager (150) in possession of a handheld pager (155) can receive a page (e.g. an alarm and/or message) (157) and take an action. Some well known brands of pager's (155) are Motorola Advisor, and Skytell Skyword. Local paging networks are provided by companies like Bell South, US West, etc. Companies like Skytell, AT&T and Motorola provide satellite networks.

Note that in an alternative embodiment, the paging company can be a provider of any of a number of telecommunication links that permit transmission of information, like status information in storage 135, to be communicated to other systems 100 in remote locations. These well known communication links 160/162 can include computer network links, phone lines, and/or satellite. In systems like this, storage area owners, like cat dealerships or vehicle manufactures, can communicate status information between storage areas in distant locations. For example, a dealership of a car manufacturer in California can transmit a service record of a vehicle to a dealership in New York so that the service record (status information) can be used by a system 100 at the New York dealership when the vehicle passes through an access area at the New York dealership.

Figure 2:
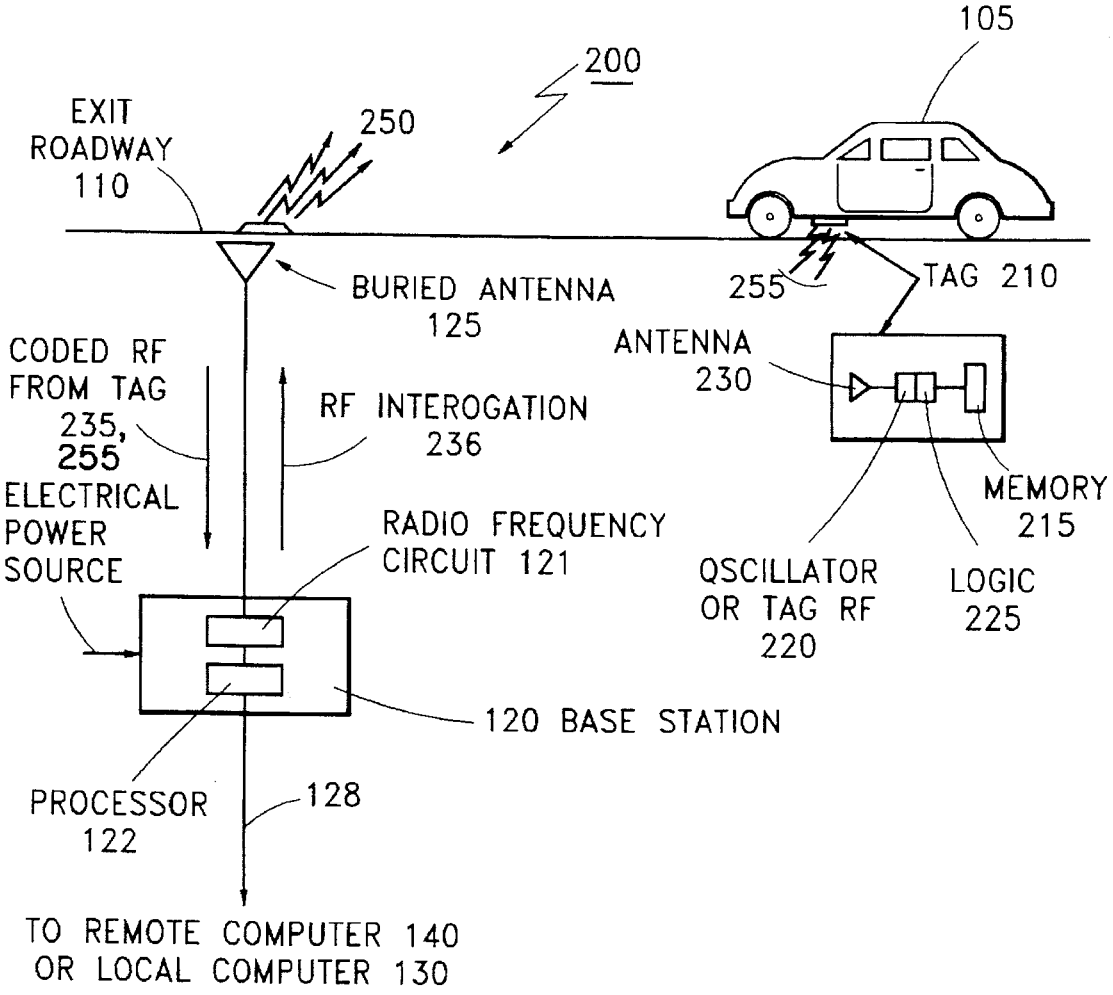
FIG. 2 is a block diagram of one preferred embodiment including a vehicle, a radio frequency tag attached to a vehicle, a base station, an antenna, and a lot entrance.

Shown in FIG. 2 is a vehicle passing through (200) an area access, specifically a single roadway (110), leading out from a vehicle dealer's vehicle lot (101 local or 102 remote). It is assumed that this roadway (110) is the only means of passage (area access, 110). If not, additional antennas (125) can be installed at each other entrance/exit (110), all connected to a base station (120). Additional base stations (120) may be used as appropriate. An RF lag (active or passive) (210) is attached to each vehicle (105). In a preferred embodiment, the RF tag (210) is affixed to the underside of metal member via an insulating or dielectric plate approximately equal in thickness to a quarter wavelength of the RF carrier. With appropriate antenna design, no dielectric spacer is necessary for tag attachment to metal directly. The mounting necessary to overcome the shorting effects mounting on metal are well known by people skilled in the art of antenna design. Alternatively, the tag can be mounted on a non-metallic portion of the vehicle's underside. Mounting on other locations of the vehicle (105) are possible, as long as the mounting and location of the RF tag (210) on the vehicle (105) does not interfere with the communication between the tag (210) and the base station (120).

The RF tag (210) comprises a tag antenna (230), tag logic (225), tag oscillator or radio frequency component (220) and a tag memory (215). The base station (120) sends a RF interrogation (236) radio frequency signal (250) via buried antenna (125) to the antenna (230) on the tag (210). This can be a continuously repeated request. The logic (225) on the tag then reads the vehicle information, e.g., Vehicle ID (FIG. 6A, 602) from the tag memory (215). The oscillator or tag RF section (220) puts the vehicle ID information on the return RF signal (255) which is sent back to the base station (120) via the tag antenna (230). The return RF signal (255) sent by the tag (210) is received by the base station antenna (125). The base station (120) then extracts the vehicle ID information (235) from the return RF signal by known methods. One preferred embodiment of a base station/tag communication apparatus is given in U.S Pat. No. 4,075,632 to Baldwin et al. issued Feb. 21, 1978 which is herein incorporated by reference in its entirety.

Note that in alternative preferred embodiments, the request signal (250) sent by the base station (120) can request that the tag logic (225) place information, like status information, on the tag memory (215). For example, a request radio frequency signal (250) might provide a vehicle service record to the RF tag 210 and also cause the tag logic (225) to store the service record in the tag memory (215).

At a later time, a base station (120) could then access the service record from the tag memory (215) with a second request radio frequency signal. In one preferred embodiment, the service record can be part of the vehicle identification record (see block 624 of FIG. 6A). In alternative embodiments, the service record is stored in a location of the tag memory (215) different than the vehicle identification record (601). The service record might be status information (see box 338 of FIG. 3B) provided by the base station (120)

In a preferred embodiment, the base station antenna (125) is buried under the exit roadway (110) so that any vehicle passing through this access (110) is interogated by the RF base station (120). The return signal (255) from the tag as a result of the interrogation contains the vehicle ID (602) information that identities the vehicle (105). The information is sent to a computer (130 if main lot or 140 if remote lot) which reads the vehicle ID (602) identification information from the return signal (255) and adds the driveway lot entrance identification or base station antenna location. In alternative embodiments, this function can be performed by the base station processor (122). Another preferred embodiment includes multiple antennas (125) at each access (110) allowing the base station processor or local computer to determine the direction the vehicle was traveling, entering or exiting the lot.

Information contained in the computer systems (130, 140) is transmitted over communication links (145) so that vehicles leaving one lot (101) can enter another (102) and still be tracked. This feature is particularly useful for rental car companies and vehicle dealers that transport vehicles between lots. This feature allows for added flexibility and convenience yet maintains the overall vehicle inventory control when each lot is part of an enterprise network of lots.

FIG. 3 is a flow chart showing the steps of a preferred vehicle monitoring algorithm (300). See FIG. 3A. The algorithm waits (305) for an interrupt from either a main base station (309) or an interrupt (307) coming from a remote computer (140) attached to one or more remote base stations (120). The interrupt is generated when the base station (120) detects that a vehicle is passing through an area access (110). As stated above, this occurs when the base station (120) detects a return signal (255) from a tag (210) on the vehicle (105) passing through the area access (110). In step (310) the algorithm (300) reads vehicle ID (602) information and determines the lot, lot access and date/time. See FIG. 6A. As stated above, the vehicle information (the vehicle ID identification) is determined by the base station (120) from the return signal (235). Some status information (lot/entrance and time information) is provided by the base station processor (122), remote computer (140), or central computer (130).

The next step is to read (312) additional status information including the Vehicle Identification File (314) in order to obtain complete information about the vehicle. In step (313) the validity of the ID (602) is determined. A tag is considered valid if a corresponding Vehicle Identification Record (601) exists for the ID (602). In one preferred embodiment these Vehicle Identification Records are indexed on ID field (602) for fast file access. In the future when many dealers use vehicle IDs it will be increasingly important to identify vehicles that were not owned or sold by the dealer (step 313). Past service records for vehicles can be very important in diagnosing a current vehicle problem. When a vehicle is identified as not in this computer system (313), a request (315) can be sent to a network of other dealer systems to fetch the appropriate service records. This technique is well known by those specialized in the art of computer networking. The algorithm then moves to FIG. 3C where the system tests to determine if the vehicle has come on the lot for servicing (342). If service is preformed a check is made when the vehicle leaves to assure that all service was completed (347) and the bill paid (352). See FIG. 3D.

In one embodiment, the Vehicle Identification Record (601), particularly an Owner field (615), is checked in step (317) to determine if the vehicle is owned by the dealership "Dealership" or has been purchased by a customer (Customer Name, e.g. Bill Anderson). If the Owner field (615) is a customer then the algorithm moves to FIG. 3C as above, where a test is made to determine if the vehicle is in for service. If the Owner field (615) is equal to "Dealership" then the hours the particular lot, main (101) or remote (102), is closed are determined in step (355) of FIG. 3B from a Lot Hours Closed File (358). Step (360) provides the capability to change the information in the Lot Hours Closed File (358). In a preferred embodiment, the Lot Hours Closed Records (670) is kept sequenced by lot, date and time. If the lot selected is not scheduled to be open at this time (675) in step (365) then an indicator is set to "Stolen Vehicle" and a message is sent to the Dealership General Manager to initiate appropriate action. The algorithm then goes to FIG. 5 (500) to initiate a page. If the lot is selected to be open at this time (675) in step (365) the Vehicle Out of Lot Record (680) is written (385) to the Vehicle Out of Lot File (390) in a preferred implementation the Vehicle Out of Lot File (390) is kept sequenced by Vehicle ID (681), Date (685), Time (687) and In/Out (689) fields. In step (392) the Vehicle Out of Lot File (390) is read for the particular Vehicle ID (680) to determine if there is both an In and Out record (680). If both records exist the lapsed time (687) is calculated. If there was an In and Out Record (680) both records are erased. The Vehicle Marketing Summary File (395), which contains marketing information about the number of times the vehicle has been taken off the lot (695) and the total time out of lot (697) is then updated with the vehicle total time driven (697) and the total number of times the vehicle has been driven (695). The algorithm then returns to the wait for another interrupt step (305).

Figure 3A:
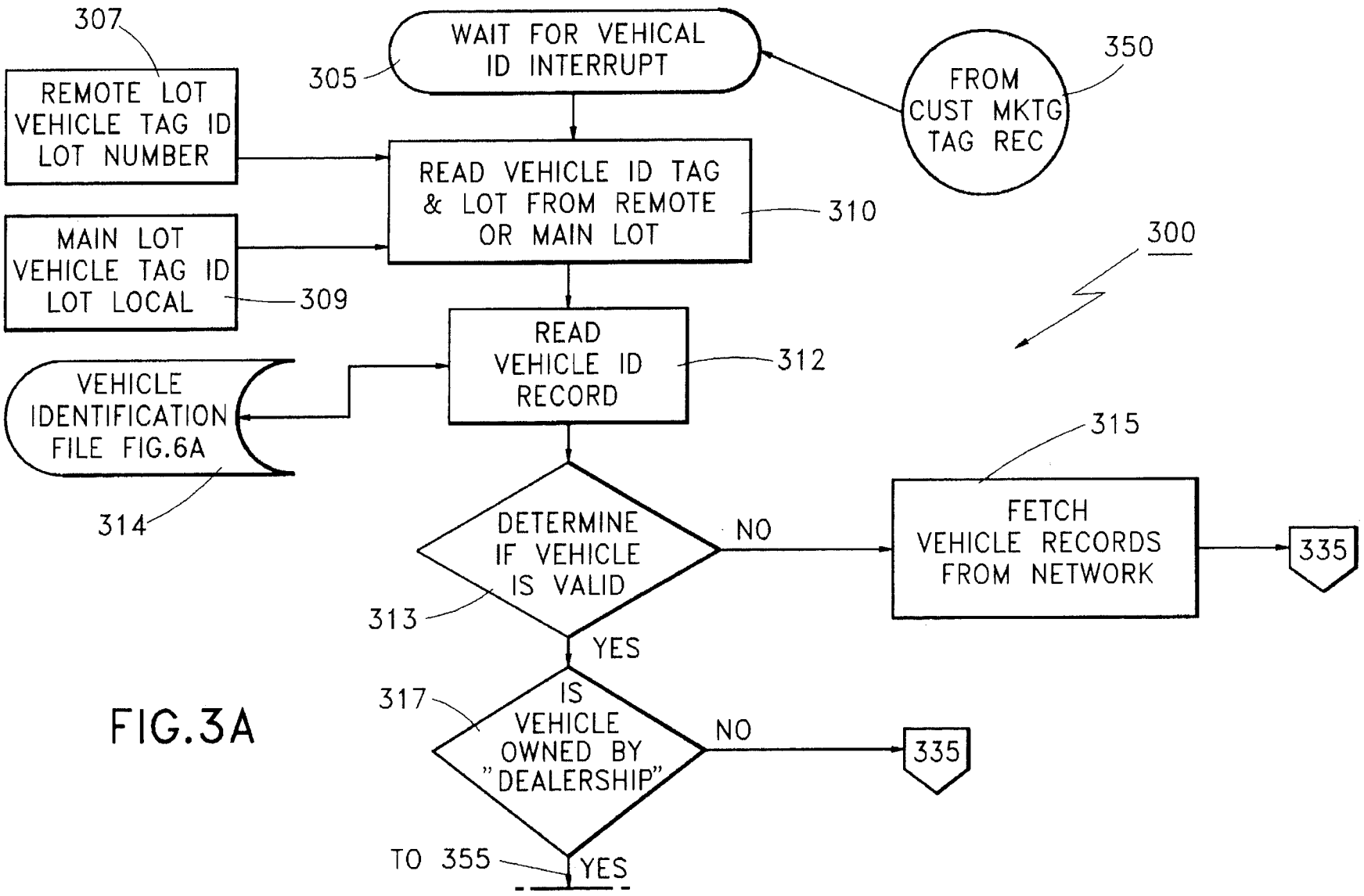
FIG. 3A is a flow chart showing the steps of an algorithm that handles vehicle tracking, ownership, and identification.
Figure 3B:
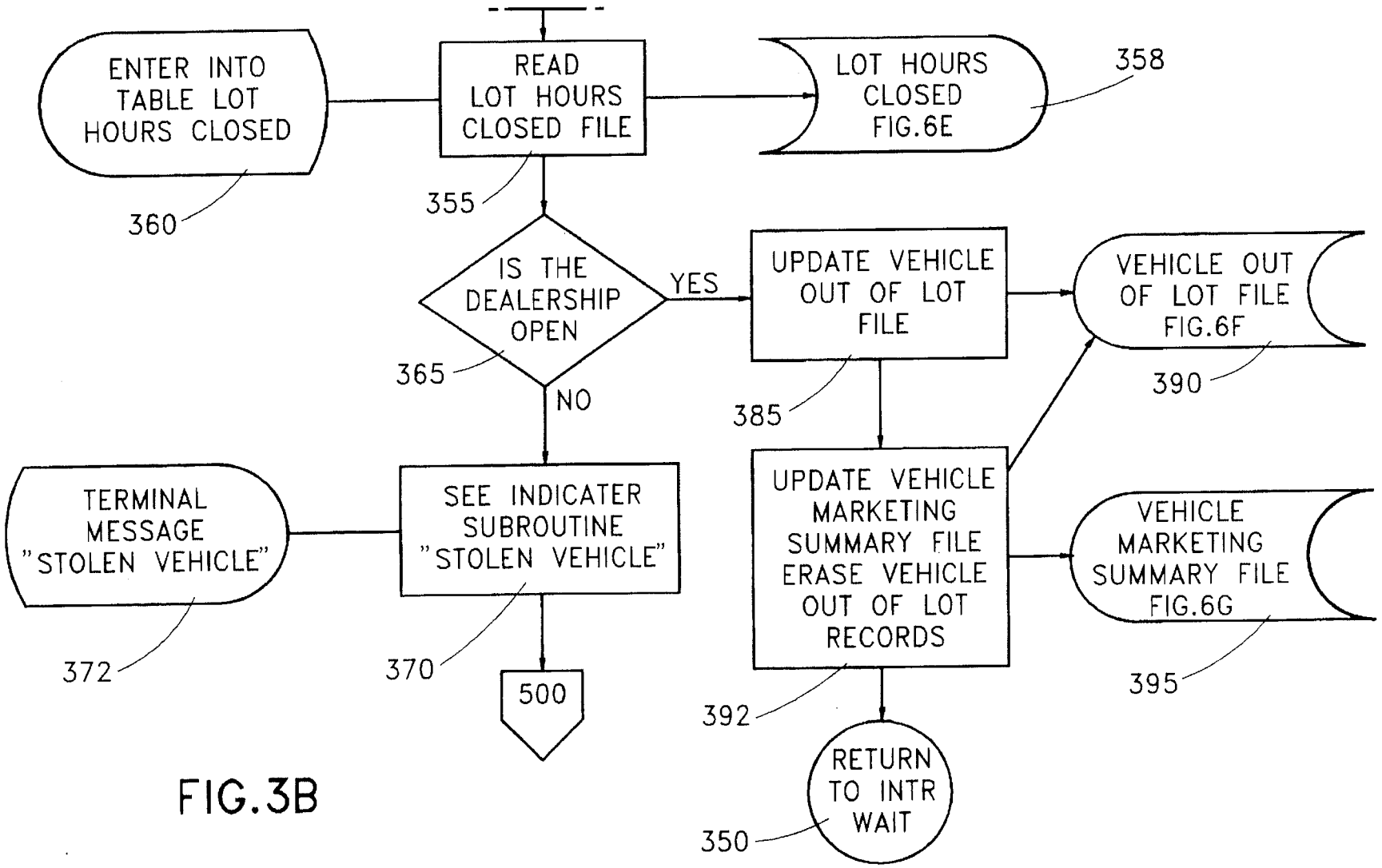
FIG. 3B is a flow chart showing the steps of an algorithm that handles determining if a vehicle is stolen from a closed dealership and gathering marketing information about a number of vehicle test drives.
Figure 3C:
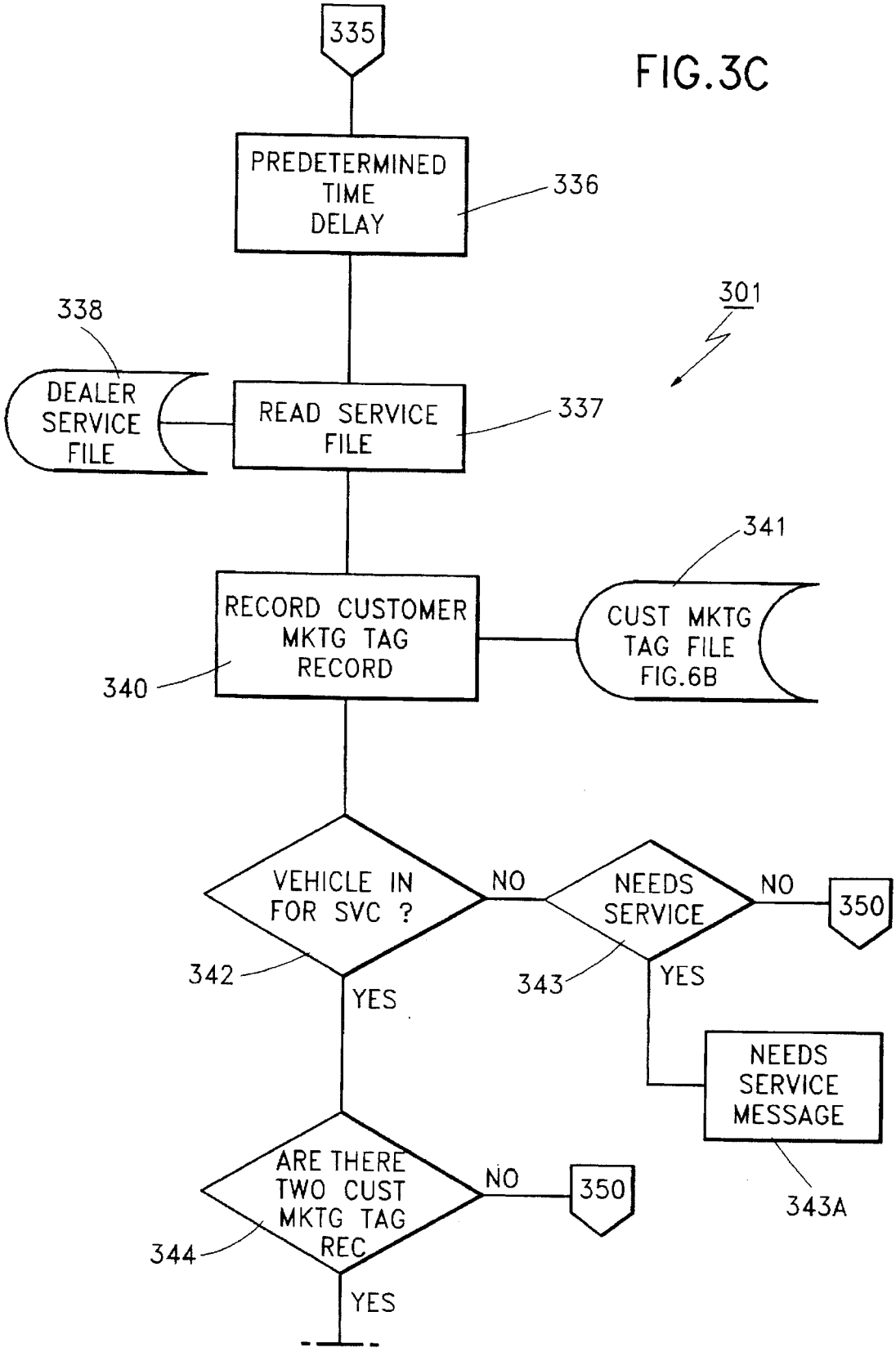
FIG. 3C is a flow chart showing the process steps determining if the vehicle needs service and whether the vehicle is in for service.
Figure 3D:
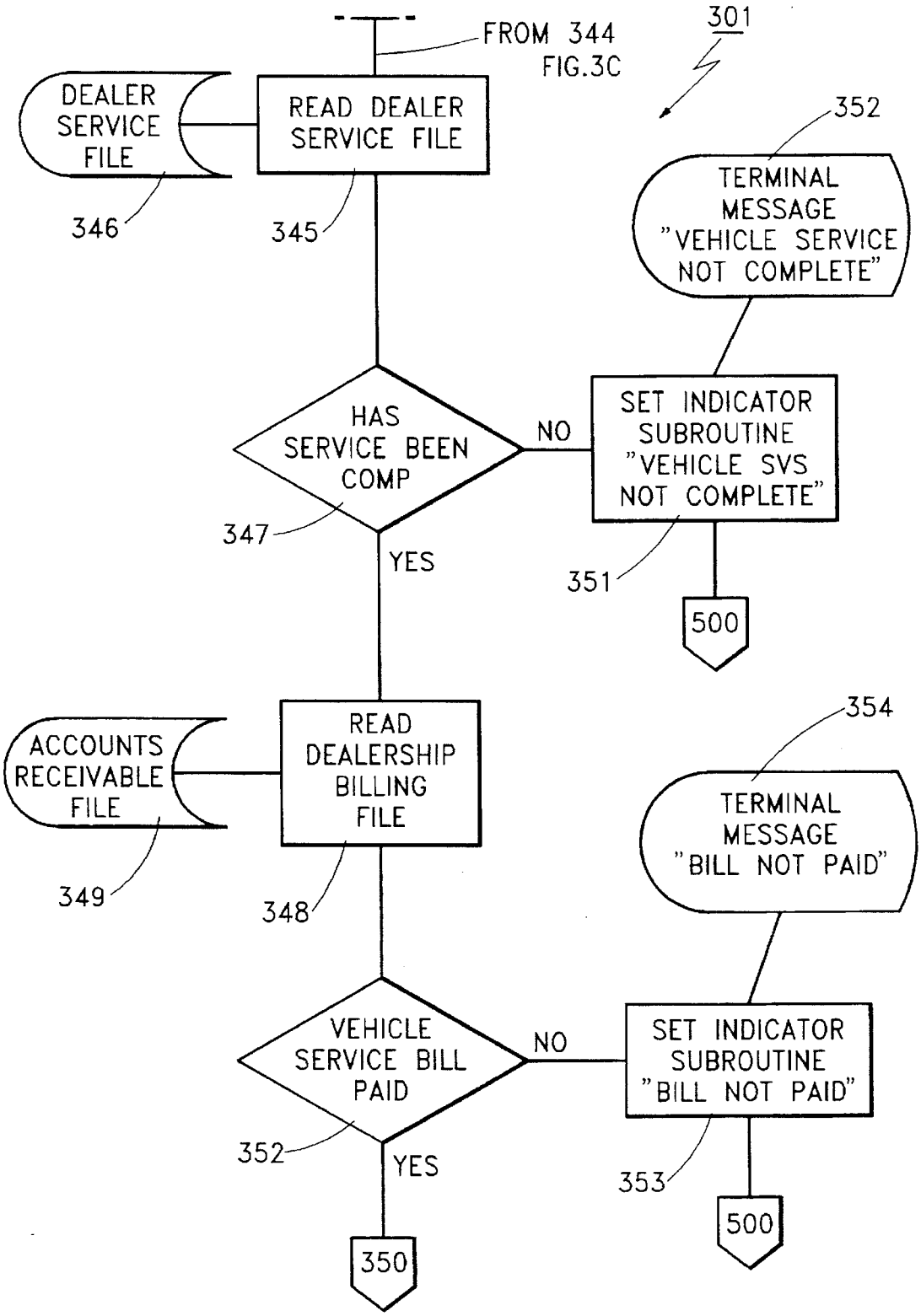
FIG. 3D is a flow chart showing the algorithm determining if vehicle service is complete and the bill for this vehicle has been paid.

FIG. 3C is a flow chart (301) entered because the vehicle ID identified was not valid (313) or the vehicle ID identifies not owned by the dealership (317) in FIG. 3A (300). After a predetermined time delay (336) which allows a customer to have a service ticket written and recorded in the computer the algorithm starts. In a preferred embodiment for automobiles the Dealer Service File (338) is read (337) for the particular vehicle ID (602) from the Dealer Management System (DMS). The art of building a Dealer Management System (DMS) with records of this type is well known in the industry. Information provided in the Dealer Service records will also be referred to as status information.

For future marketing applications the Customer Marketing Tag Record (630) is written (340) in the Customer Marketing Tag File (314). If the vehicle is not in for service (342), the algorithm returns to wait for another interrupt (350). If the vehicle is in for service, a check is made to determine if there have been two readings of the tag (344) and therefore the vehicle is leaving the lot (service completed). In block (345), the Dealer Service File (346) is rechecked to assure that all the service tasks have been completed (347). If not complete (351), the algorithm sends a message to the appropriate managers terminal (352). In one preferred embodiment the algorithm jumps to the pager algorithm (500) to inform the manager (150) by pager (155). If the service is complete, the Accounts Receivable File (349) in the DMS System is read (348) to determine if the bill has been paid to the dealership. If the bill is paid the algorithm moves back to wait for another interrupt (350). When not yet paid (353), the appropriate management terminal (354) receives the message "Bill Not Paid". In a preferred embodiment, the algorithm jumps to the pager algorithm (500) to inform the manager (150) by pager (155).

In an alternative embodiment, the algorithm (301) determines (343) from the vehicle service record and manufacture service requirements in the dealer service file (338) that the vehicle needs service. If the vehicle needs service, a message (343A) is sent to the service manager (preferably via a page) and/or to a computer terminal so that the customer can be informed of the service requirement. In other embodiments, the service record call be accessed from the tag memory (215) as part of the vehicle ID information or as an independent record on the tag memory (215). Note that these service records could have been placed on the vehicle tag memory (215) by base station (120) at any number of system (100) and/or remote computer (140) locations. Also, the service records in the file (338) could have been communicated to the system (100) from a second remote system (100) or computer (140) using the communication links.

Figure 4:
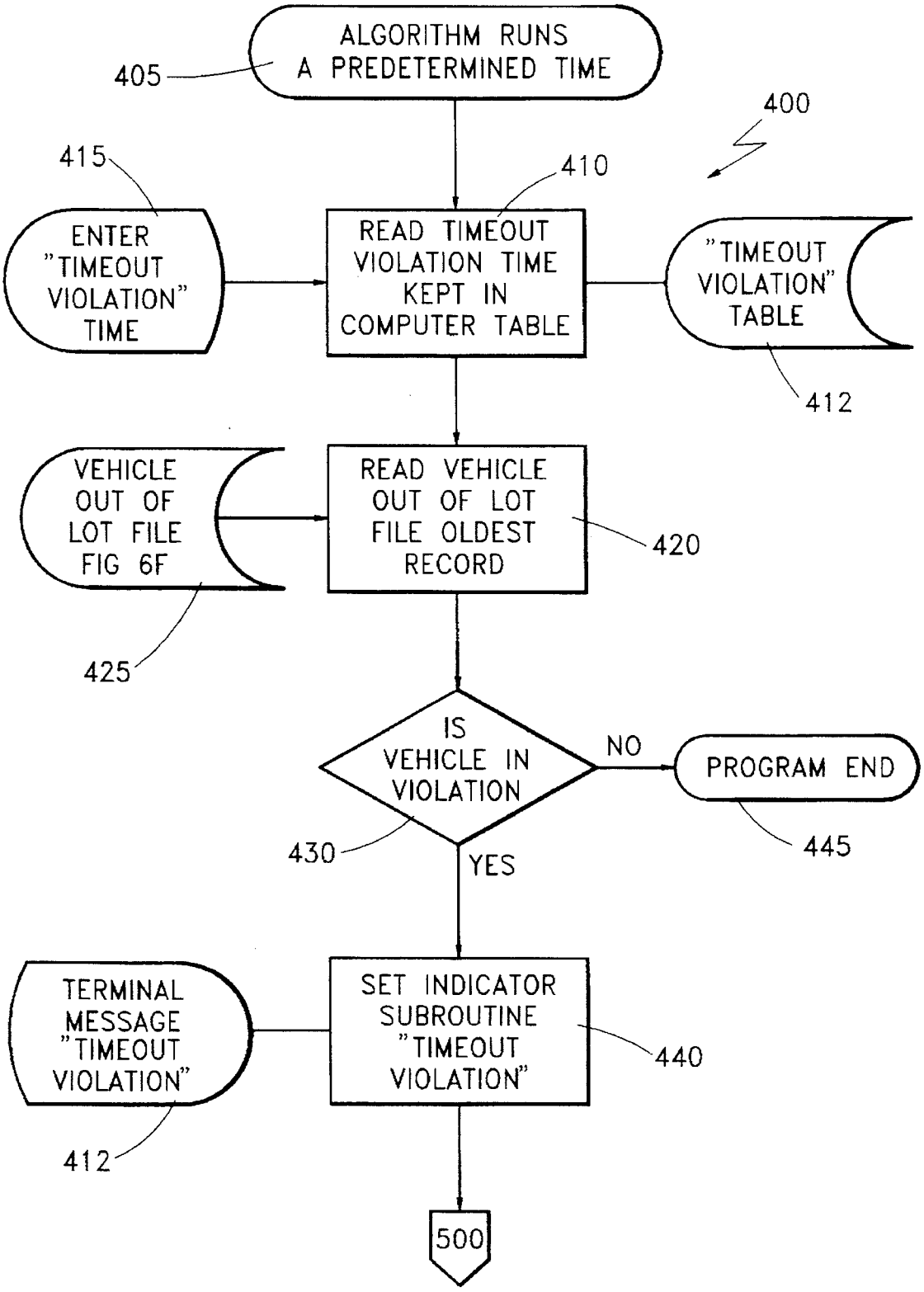
FIG. 4 is a flow chart showing the steps of an algorithm that handles the determination that a dealer owned vehicle has been out of a lot for more than a predetermined lot time, "Timeout Violation".

In one preferred embodiment a separate algorithm is used to determine if a dealer owned vehicle has been off the lot for more than a prescribed period of time "Timeout Violation". See FIG. 4. The algorithm (400) starts when a predetermined time is reached (405). Provided in algorithm (400) is the ability to enter a different "Timeout Violation" (415) for different lots, dates, etc. (410). This table (412) is typically located in the computer memory and contains two fields; lot number and the associated lot "Timeout Violation" parameter. (e.g., lot 5, 2 hours) The Vehicle Out of Lot File (425) is sorted, descending based on In/Out, Date and Time, and is is read (420) looking for the record of a vehicle that has been out of a lot (430) for more than the time set in in table (412). Typically the vehicle out of the lot the longest is the first record because each new vehicle leaving the lot is added to the end of the file. Typically, the first record in this file is the vehicle gone the longest from the lot. These records were originally written on the file (390) in block (385). When a vehicle is in violation, an indicator is set with "Timeout Violation" (440) and a message is sent to the Sales Manager's terminal (442) indicating a dealer owned vehicle has been gone for more than the predetermined time for this lot. If there is no violation (430) the algorithm ends. The algorithm will restart at the next predetermined interval (405).

Figure 5:
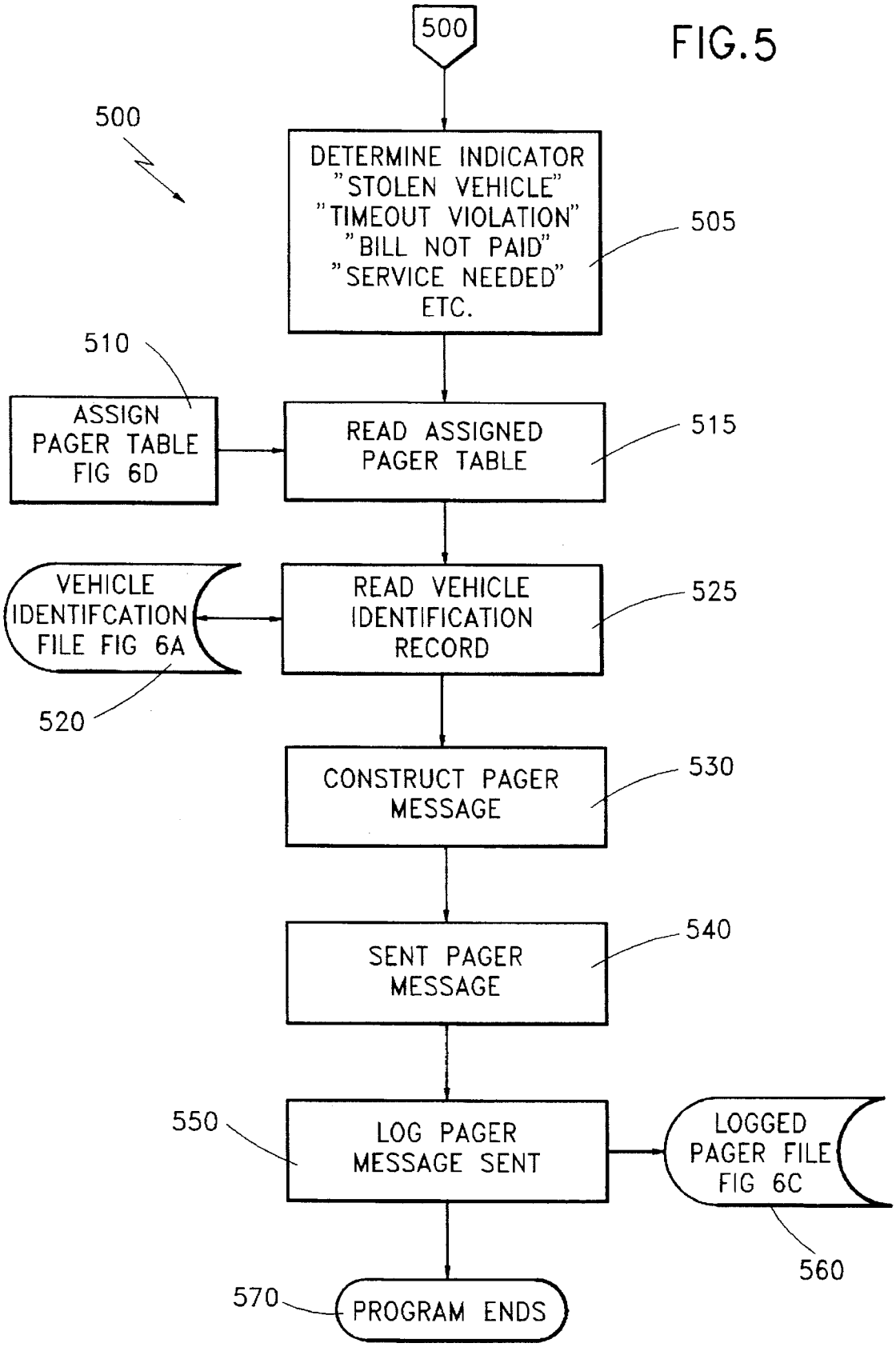
FIG. 5 is a flow chart showing the steps of an algorithm that performs the constructing, sending, and logging of pages.

FIG. 5 is a flow chart (500) of an algorithm that begins the automated paging system. In step (505) this algorithm (500) notes the type of indicator. Based on the type of situation the phone number and pager number of the appropriate manager/person (sales, security, service, accounting, etc.) to be contacted is read (515) from the Assigned Pager File (510). Next the Vehicle Information is read in block (525) from the Vehicle Identification File (520). In one preferred embodiment using alphanumeric pagers the next block (530) constructs the message (string of characters) to be sent to an pager. The computer (130) makes the connection in step (540) to a dial line (161) and dials the appropriate phone number. Based on the indicator that had been set, i.e. with an alphanumeric pager and "Stolen Vehicle" a message is sent (660) to the General Manager that a vehicle has been stolen In the Assigned Pager Record (660) the indicator is referred to as Incident (661). In similar manor, with an alphanumeric pager and "Timeout Violation" a message is sent (660) to the Sales Manager that a vehicle has exceeded the storage area/lot timeout parameter. In similar manor, with an alphanumeric pager and "Service Not Complete" a message is sent (660) to the Service Manager that a vehicle has left the lot without all service completed. Alternatively, a message is sent (660) to the Service Manager that the vehicle needs services. In similar manor, with an alphanumeric pager and "Bill Not Paid" a message is sent (660) to the Accounting Manager that a vehicle has left the lot without payment of the bill. As a final step (550) the computer logs the paged message in the Logged Pager File (560). In a preferred embodiment the AS/400 integrated with PagerPac/400 software allows easy and quick implementation of the above described paging through the PagerPac/400 software.

FIG. 6 is a block diagram that shows one preferred field layout of each of the records containing status information in the computer (130). These records are typically located in the files (135) connected to the main computer (130).

Figure 6A:
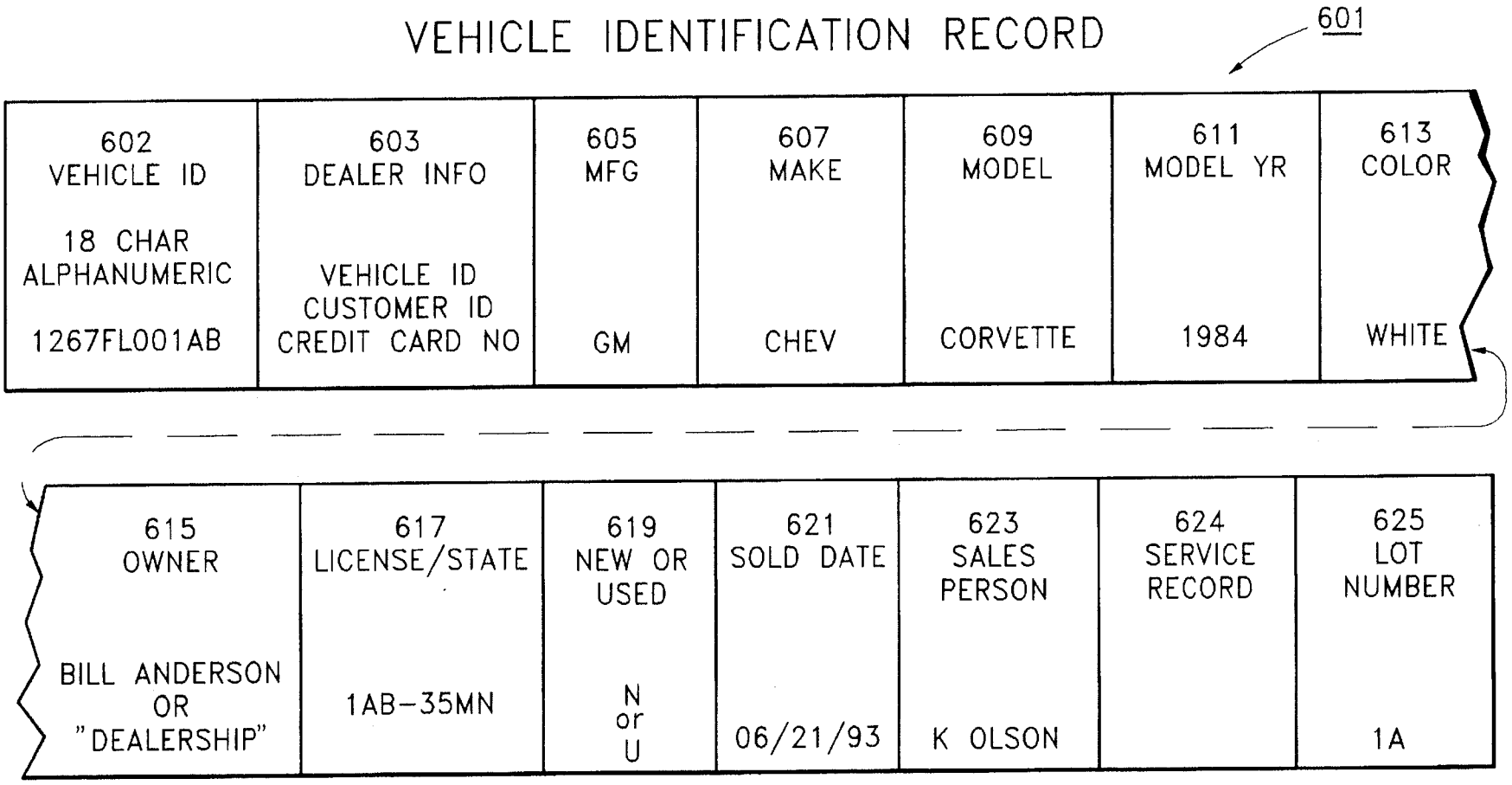
FIG. 6 is block diagrams of the preferred data structure of the records and tables used in the applications: Vehicle Identification Record (FIG. 6A), Customer Marketing Tag Record (FIG. 6B), Logged Pager Record (FIG. 6C), Assign Pager Record (FIG. 6D), Lot Hours Closed Record (FIG. 6E), Vehicle Out of Lot Record (FIG. 6F), and Vehicle Marketing Summary Record (FIG. 6G).

FIG. 6A is block diagram of Vehicle Identification record (601) that contains several fields of information about the vehicles (105) that have vehicle tags (210). The length of the fields should be flexible to handle the values the dealer wishes to implement.

The ID (602) field is set to a unique vehicle identification. In a preferred embodiment for automobiles this vehicle identification is a number typically referred to as the vehicle VIN, and is eighteen alphanumeric characters provided by the vehicle manufacture. This code uniquely identifies the vehicle in the case of automobiles along with providing information on the vehicles characteristics such as engine, color, transmission, etc. The tenth digit is typically the year the vehicle was manufactured.

The Vehicle ID (603) field can be used for a unique identifier within the dealership. Carefully coding this field can provide information such as the cost of the vehicle, date purchased, where the vehicle came from, mileage, etc.

The field could be used, as example, by the dealer to indicate dealer customer number, credit card number, dealer vehicle number and the status of a customer such as preferred, deluxe, etc.

The Mfg field (605), provides information about the original manufacture of the vehicle. Examples are GM, FORD, CHRYSLER, etc..

The Make field (607), includes information about the make of the vehicle. Examples are Chevrolet, Ford, Plymouth, etc.

The Model field (609), includes information about the model of the vehicle. Examples are Corvette, LTD, Reliant, etc.

The Model Yr field (611), includes information about the vehicle model year that the vehicle was manufactured. Typically this field would be four numeric digits.

The Color field (613), includes information about the vehicle color. Typically this field would contain a color such as green, white, TT blue (two tone blue). Alternatively this field could contain the manufacturc's color code.

The Owner field (615), includes information about who owns the vehicle. If the vehicle is owned by the dealer, this field has the dealership name or "Dealership". If the vehicle has been sold, the name in this field is the new owner. Respectively examples are Saturn of St Paul, Donald Johnson, etc.

The License/State field (617), contains the alphanumeric information from the license, and two alphanumerics for the state. An example is 123-SJB MN for a license in the State of Minnesota.

The New or Used field (619), has information indicating if the vehicle is new (N) or used (U).

The Sold Date field (621), contains the date the vehicle was sold. Typically, the field is eight alphanumeric digits, example Jun. 23, 1994.

The Salesperson field (623), contains the name of the person in the dealership that sold the vehicle, example Karen Smith.

The Service Record field (624) contains the service record of the vehicle, e.g., the last time the oil was changed or the tires were rotated.

The Lot Number field (625) contains the lot the vehicle is currently assigned to if the enterprise has multiple lots or the lot the vehicle was sold from, example A1, 34, B, MPLS, ROCH, etc.

Figure 6B:
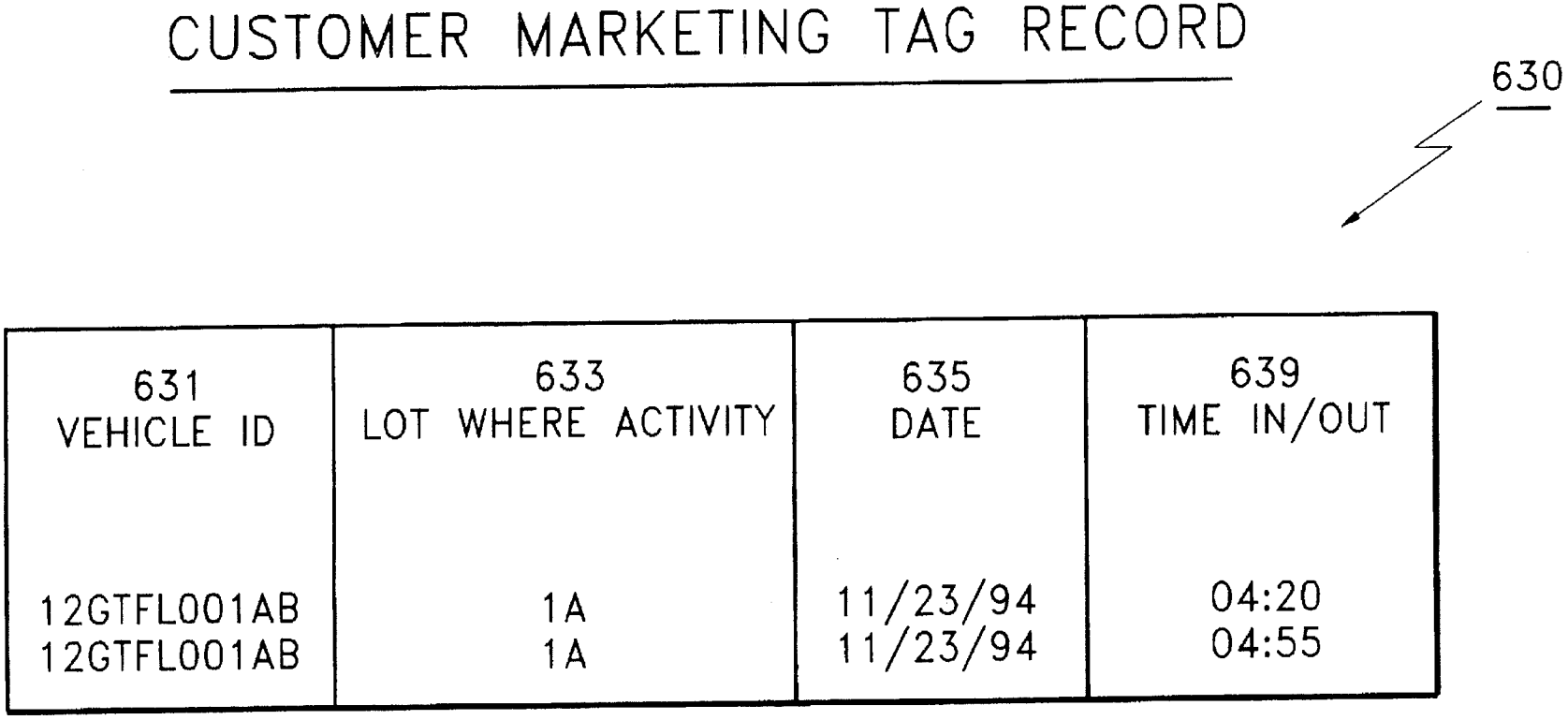

FIG. 6B is a block diagram of a Customer Marketing Tag Record (630) that contains the information about customers which have tags on their vehicles, that have returned to a lot to look at potentially purchasing another vehicle.

The ID field (631) has the same description as field (602).

The Lot Where Activity field (633) contains the alphanumeric designation of the lot which a vehicle with a tag entered. Further detail can be found in the description of field 625.

The Date field (635) contains the date the customer vehicle with a tag was driven on the lot. Example Sep. 21, 1994.

The Time IN/OUT field (639) contains the time the customer vehicle with tag arrived on the lot (633) example 19:50. Combining two records one for IN and one for OUT allows the algorithm block (845) in FIG. 8 in computer (130) to calculate the length of time the vehicle was on a lot.

Figure 6C:
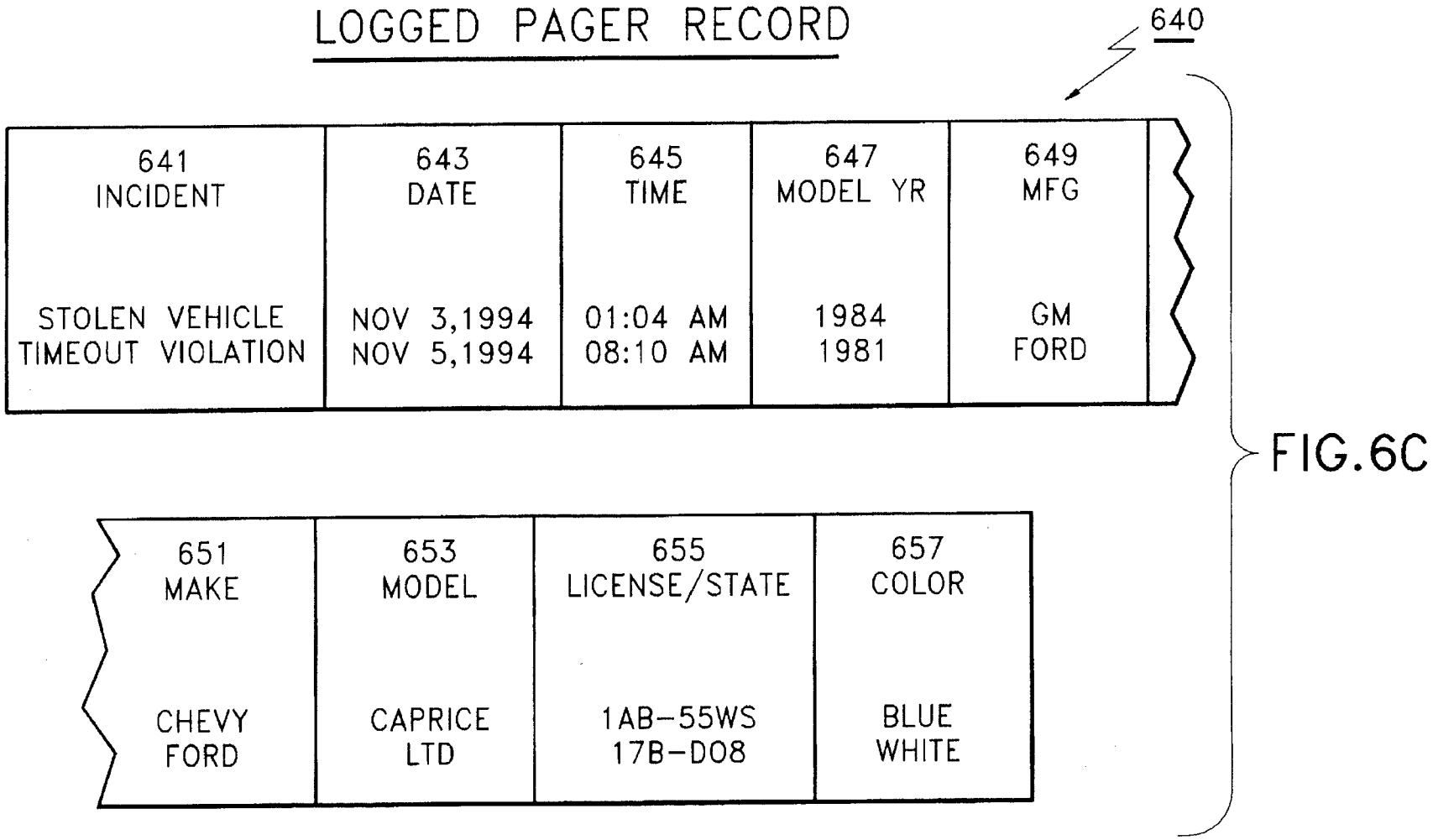

FIG. 6C is a block diagram of a Logged Pager Record (640). This record is an example of the alphanumeric page sent to the dealership management in flow chart step (540).

In the Incident field (641) there are several potential indicators "Stolen Vehicle", "Timeout Violation", "Service Not Complete", and "Bill Not Paid".

The Date field (643), in a preferred embodiment, contains the date written out for clarity, when sent to the alphanumeric pager, example Nov. 19, 1994.

The Time field (645), in the preferred embodiment contains the time written out for clarity,when sent to the alphanumeric pager, example, 11:34 PM.

The Model Yr field (647) is described in field (611).

The Mfg (649) field is described in field (605).

The Make field (651) is described in field (607).

The Model field (653) is described in field (609).

License/State field (655)is described ill field (617).

The Color field (657)is described in field (613).

FIG. 6D is a block diagram of an Assign Pager Record (660). Stored ill this file is management persons to be contacted in the dealership for a specific incidence.

The incident field (661) contains the type of page which was initiated. Examples are Stolen Vehicle, Timeout Violation, etc.

The Description field (662) contains the title description of the management persons responsible to handle the different incident situations in the dealership.

The Individual field (663) includes the actual name of the person titled in Description (662).

The Pager ID field (665), depending on the type of paging system this field, contains the paging unit number or the paging unit mfg number. A Paging unit number example is 234 or a manufactures number like 234ZA-09.

The Pager Number field (667), depending on the type of pager this field, can contain the phone number of the paging company or the phone number for a particular paging unit.

Figure 6E:
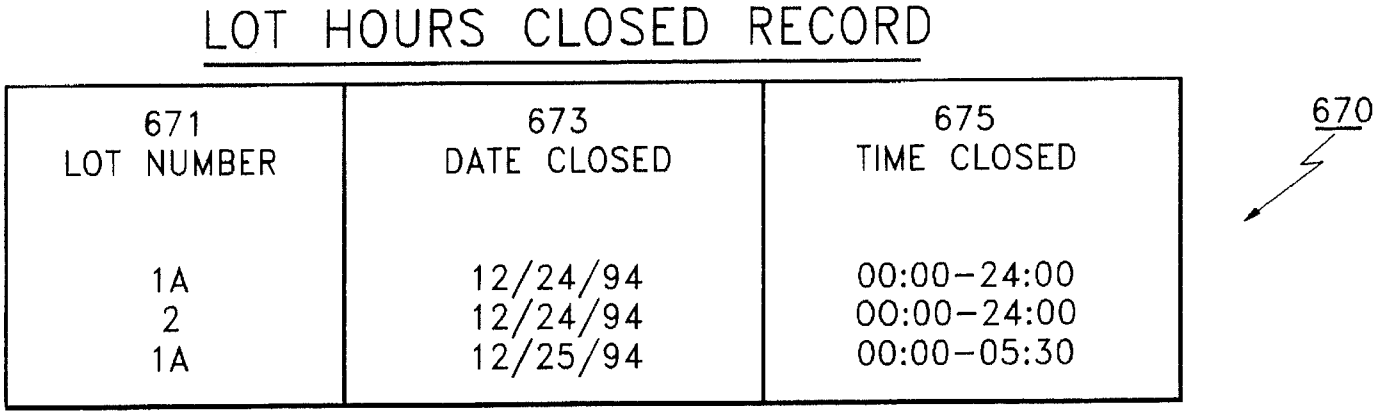

FIG. 6E is a block diagram of a Lot Hours Closed Record (670). In this table is entered the information on when each lot is closed. Different lots can have different times closed based on local laws. In New York automobile lots are closed on Sunday but in California the lots are open seven days a week.

The Lot Number field (671) is the same as described in (625).

The Date Closed field (673) contains the date matched with a time (675) that a particular lot is closed.

The Time Closed field (675) contains the time period that a lot is closed, matched with a particular Lot (671) and Date Closed field (673), example 05:00–23:15.

Figure 6F:
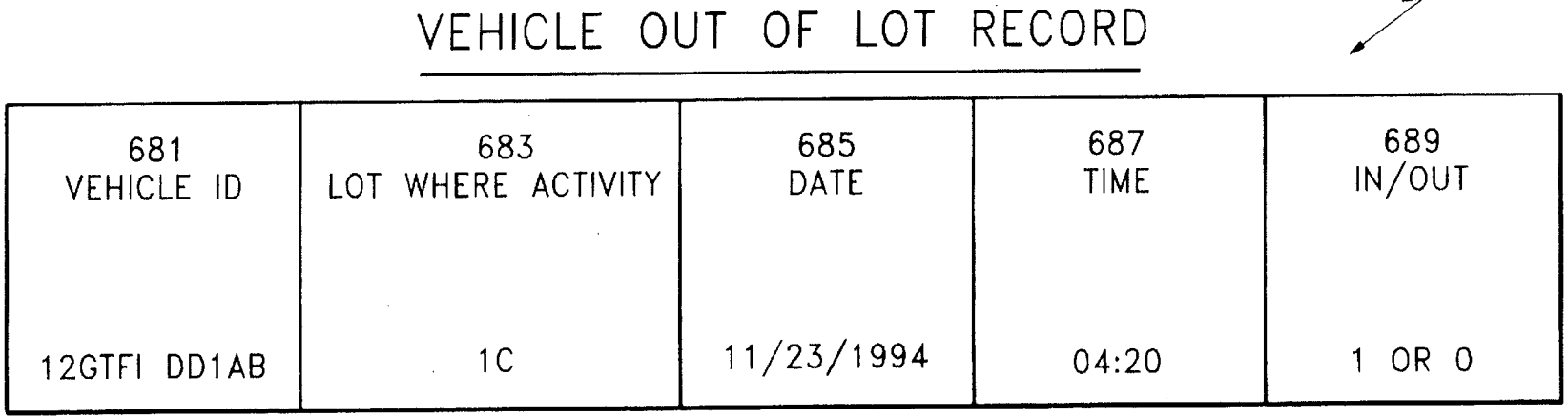

FIG. 6F is a block diagram of a Vehicle Out of Lot Record (680). This file keeps track of which dealer owned vehicles have left a lot during the hours a particular lot is open.

The ID field (681) is as described in (602) above.

The Lot Where Activity field (683) includes the identifier of where the activity occurred. See item (625) for a further lot description.

The Date field (685) contains the date matched with a time (687) that a vehicle left or entered a lot (683).

The Time field (687) contains the time a vehicle left or entered a lot (683) on Date (685).

The In/Out field (689) provides the capability to track whether a vehicle entered or exited a lot which is using a single antenna configured entrance. If the tag is added to the vehicle while it is inside the lot the first tag interrupt indicates the vehicle has exited the lot.

Figure 6G:
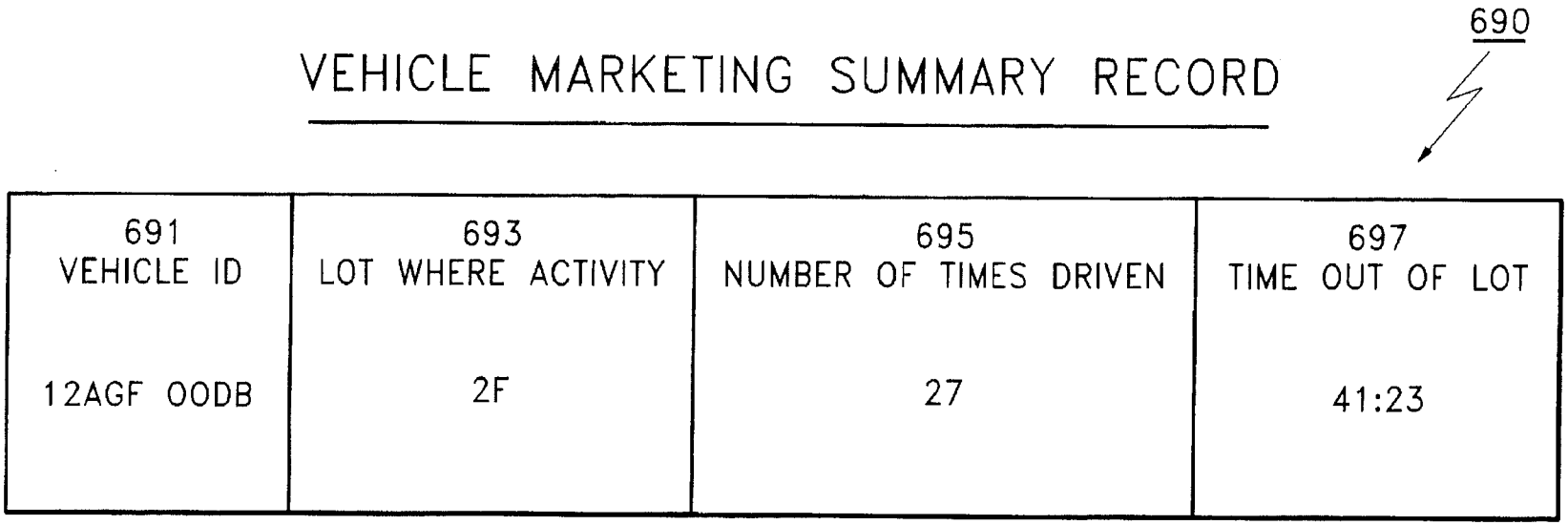

FIG. 6G is a block diagram of a Vehicle Marketing Summary Record (690). The fields in this record (690) contain information necessary for building marketing reports.

The ID field (691) and Lot Where Activity field (693) are described above in items (602) and (625) respectively.

The Number of Time Driven field (695) contains a count of the times a vehicle exited a lot on test drives. The count was determined in block (392).

The Time Out of Lot field (697) contains a running total of the hours and minutes a vehicle has been off the lot. The total time a vehicle has been off the lot is determined in block (392).

Figure 7A:
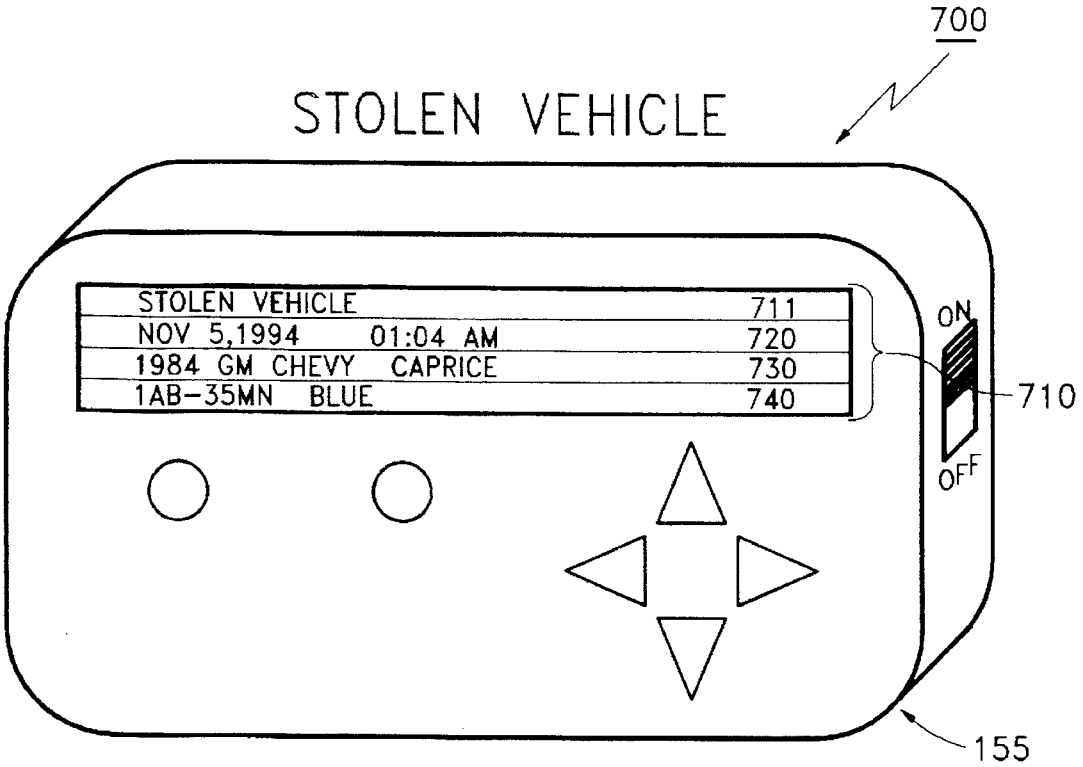
FIG. 7A is a block diagram showing typical "Stolen Vehicle" pager display.
Figure 7B:
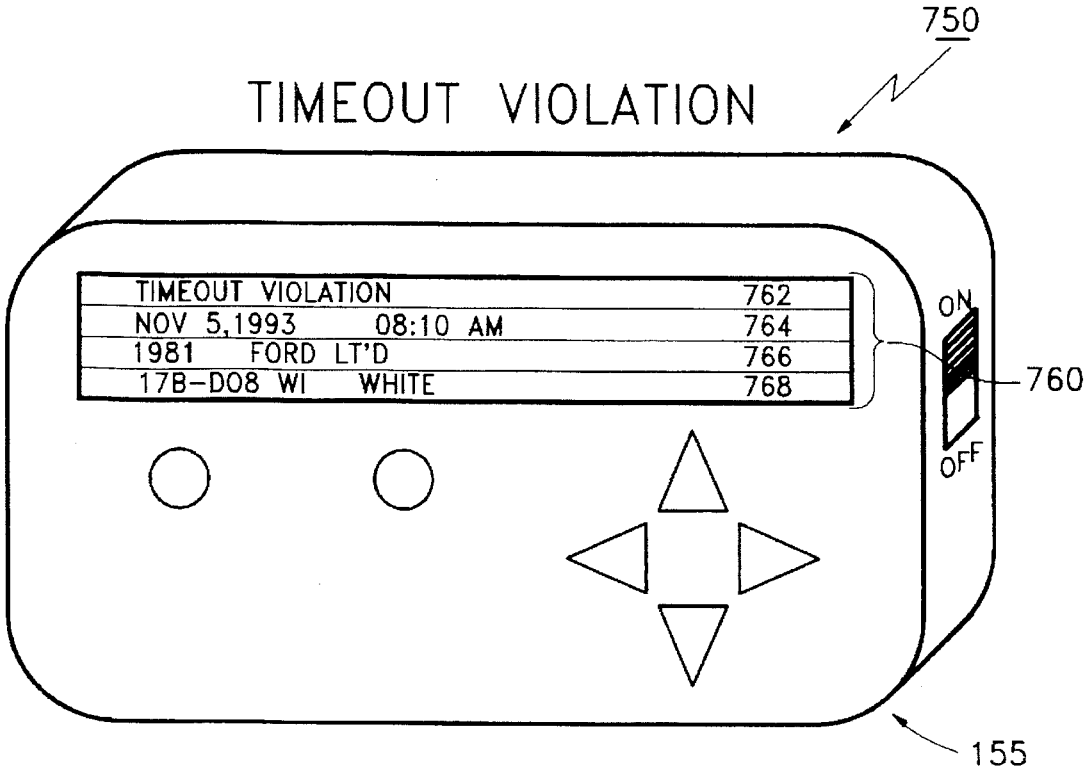
FIG. 7B is a block diagram showing typical "Timeout Violation" pager display.

FIG. 7A (700) and FIG. 7B (750) are block diagrams of pagers (155) showing the preferred message layout for the two situations, "Stolen Vehicle" (710) and "Timeout Violation" (760). A description of the information contained in 710–740 and 762–768 can be found in the Logged Pager Record FIG. 6C (640) above. In a preferred embodiment the pager is used to reach dealer management where ever they maybe based on an event occurring with a tagged vehicle entering or exiting a lot. The AS/400 in the preferred embodiment has integrated communications to dial the paging company and send a page. Additionally, PagerPac/400 software for the AS/400 easily allows applications to send an alphanumeric page. Paging diagrams for "Service Not Complete" and "Bill Not Paid" aren't shown but are similar to the shown descriptions. (710–740 or 762–768).

Figure 8:
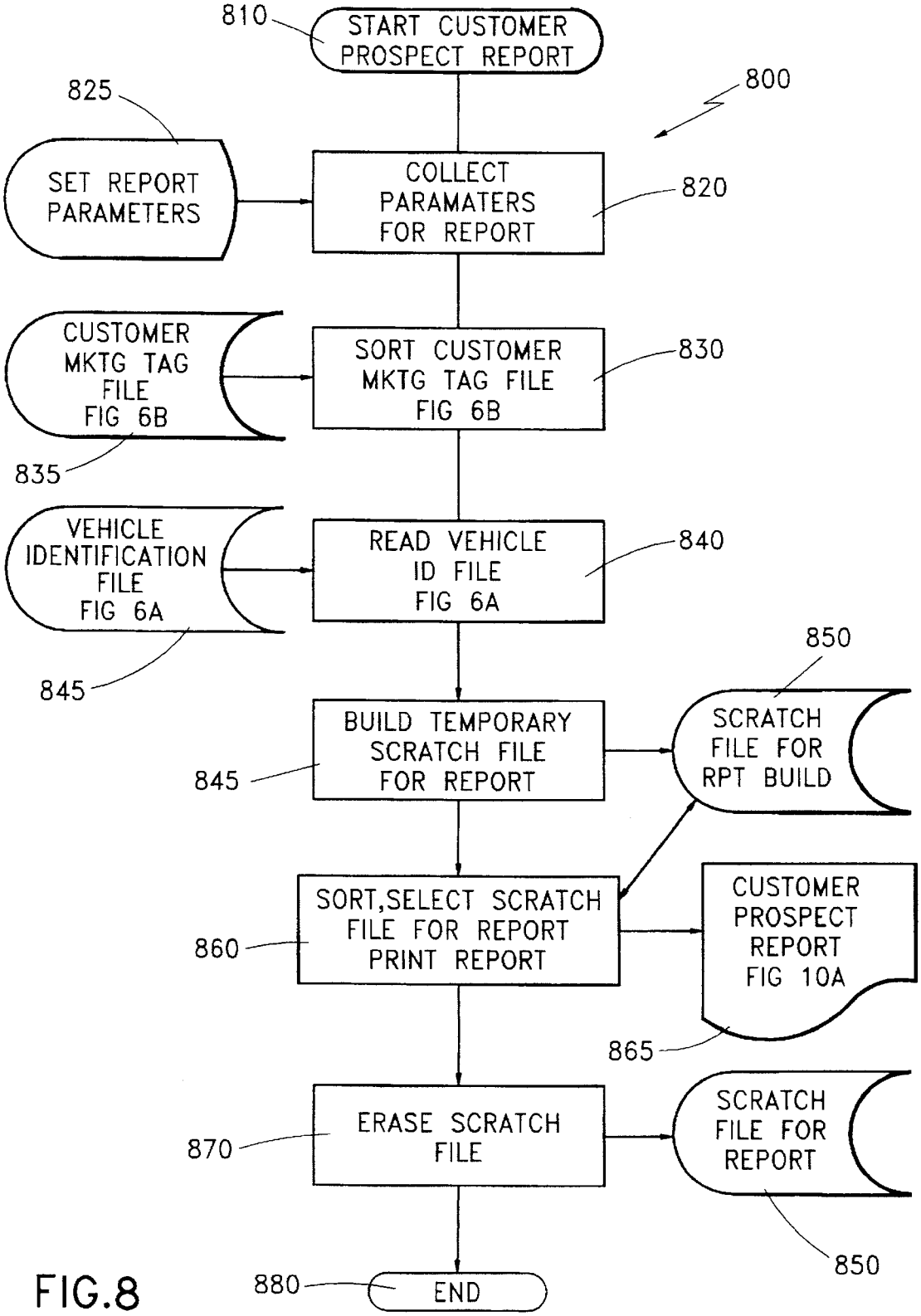
FIG. 8 is flow chart showing the steps of an algorithm that builds an marketing report based on customers with tagged vehicles reentering a lot potentially shopping for an additional vehicle.
Figure 10A:
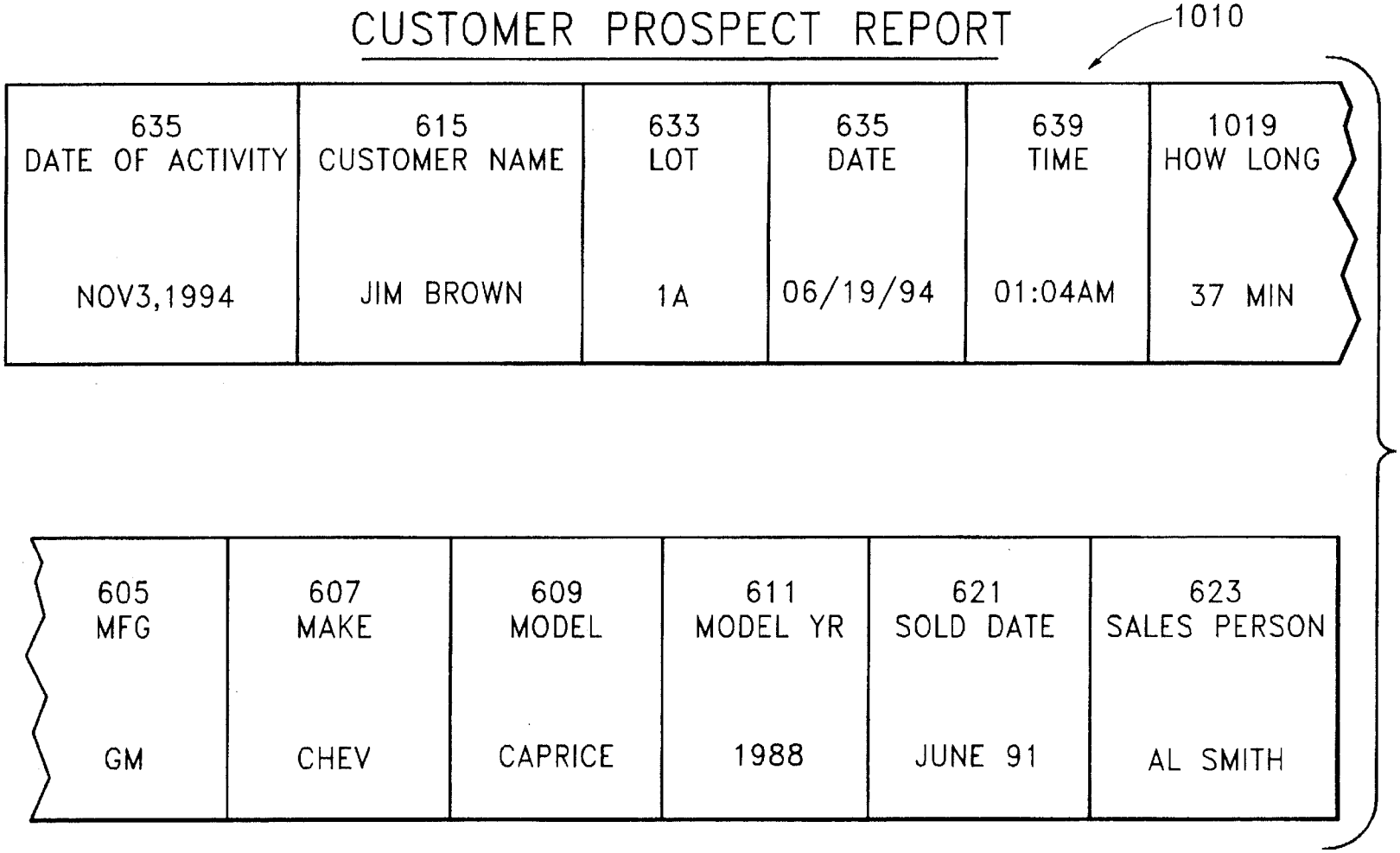
FIG. 10A is a block diagram of the preferred embodiment of the Customer Prospect Report.

FIG. 8 is a flow chart of a prospect reporting algorithm (800) used to build the Customer Prospect Report (1010) of FIG. 10A. This report is an on demand report started by an individual in the dealership. The collected report parameters (820) are set from a terminal (825), such as Date of Activity (635), Lot (633), Current Salesman (623) and others (see the fields in Report (1010)). The parameters can be set for record selectivity (860) or sorting (830) of the Customer Marketing Tag File (835). Additional information about the current customer vehicles can be obtained by reading (840) the Vehicle Identification File (845). One option is to determine how long the customer/prospect was on the lot by subtracting the In/Out times (635 and 639) times for the matched Customer Marketing Tag Records (630). A Scratch File (850) is built (845) from the fields designated in the Set Report Parameters block (825). The Preferred Customer Prospect Report (865) is now printed with final record sorting and record selections (860). As a last step the Scratch File (850) is erased in block (870). The program ends in block 880.

Figure 9:
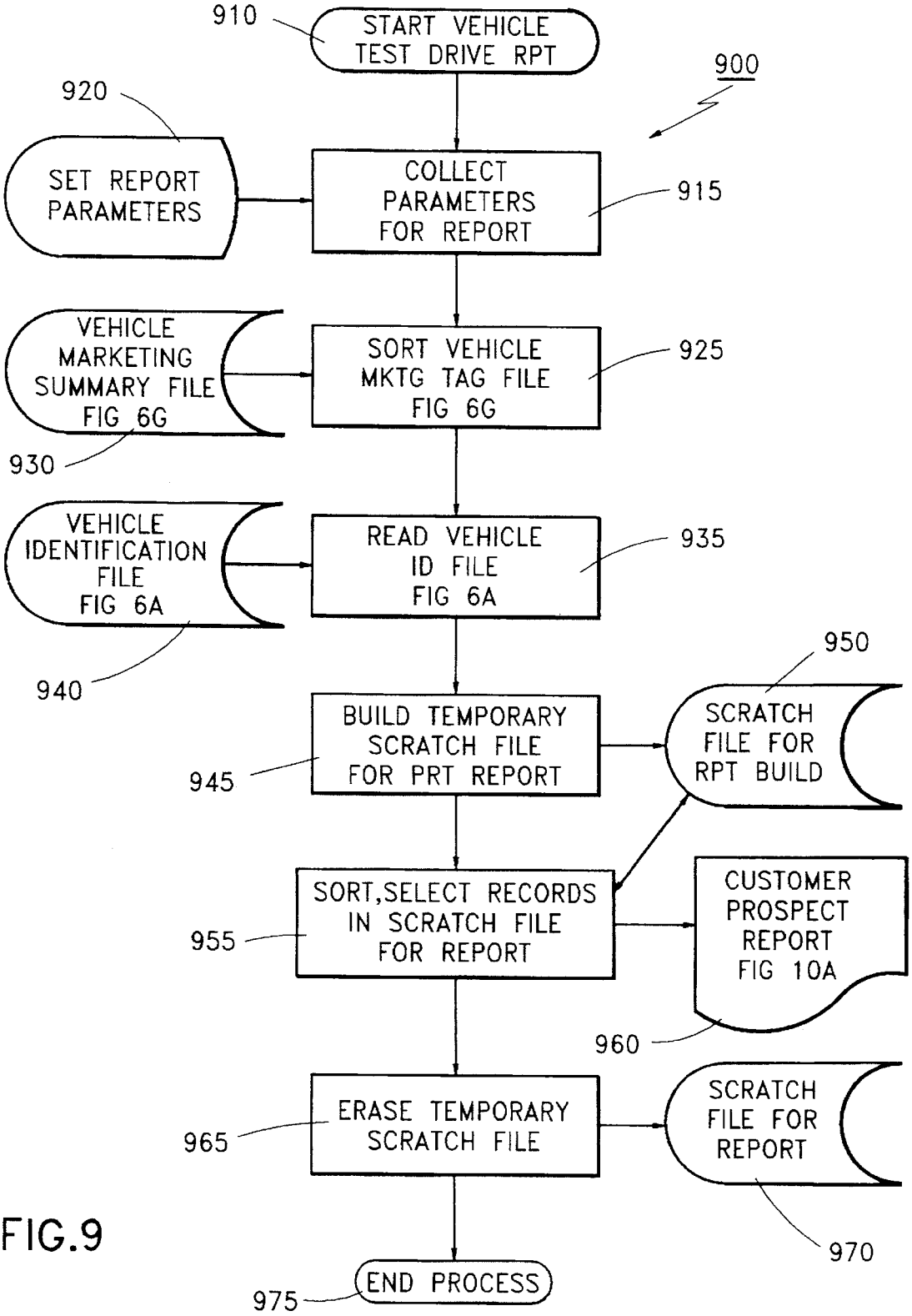
FIG. 9 is flow chart showing the steps of an algorithm that builds a marketing report based on dealer owned tagged vehicles leaving and entering a lot.

FIG. 9 is a flow chart of an algorithm (900) to build a Vehicle Test Drive Report (1050). The development of this report has steps corresponding to the Customer Prospect Report (1010) described above except that the Customer Marketing Tag File (835) is replaced by the Vehicle Marketing Summary File (930). Where the Customer Prospect Report (1010) focuses on the customer and when they came to a lot for how long, the Vehicle Test Drive Report (1050) focuses on which dealer owned vehicle was driven, how many times and for how long.

FIG. 10A contains the layout of the "Customer Prospect Report" (1010) used to determine which customers that had purchased vehicles in the past may be interested in another vehicle. All the fields in this report have previously been described except for How Long field (1019). The field was derived in block (845) by subtracting the Date (635) Time (639) for two matched Customer marketing Tag Records (630).

Figure 10B:
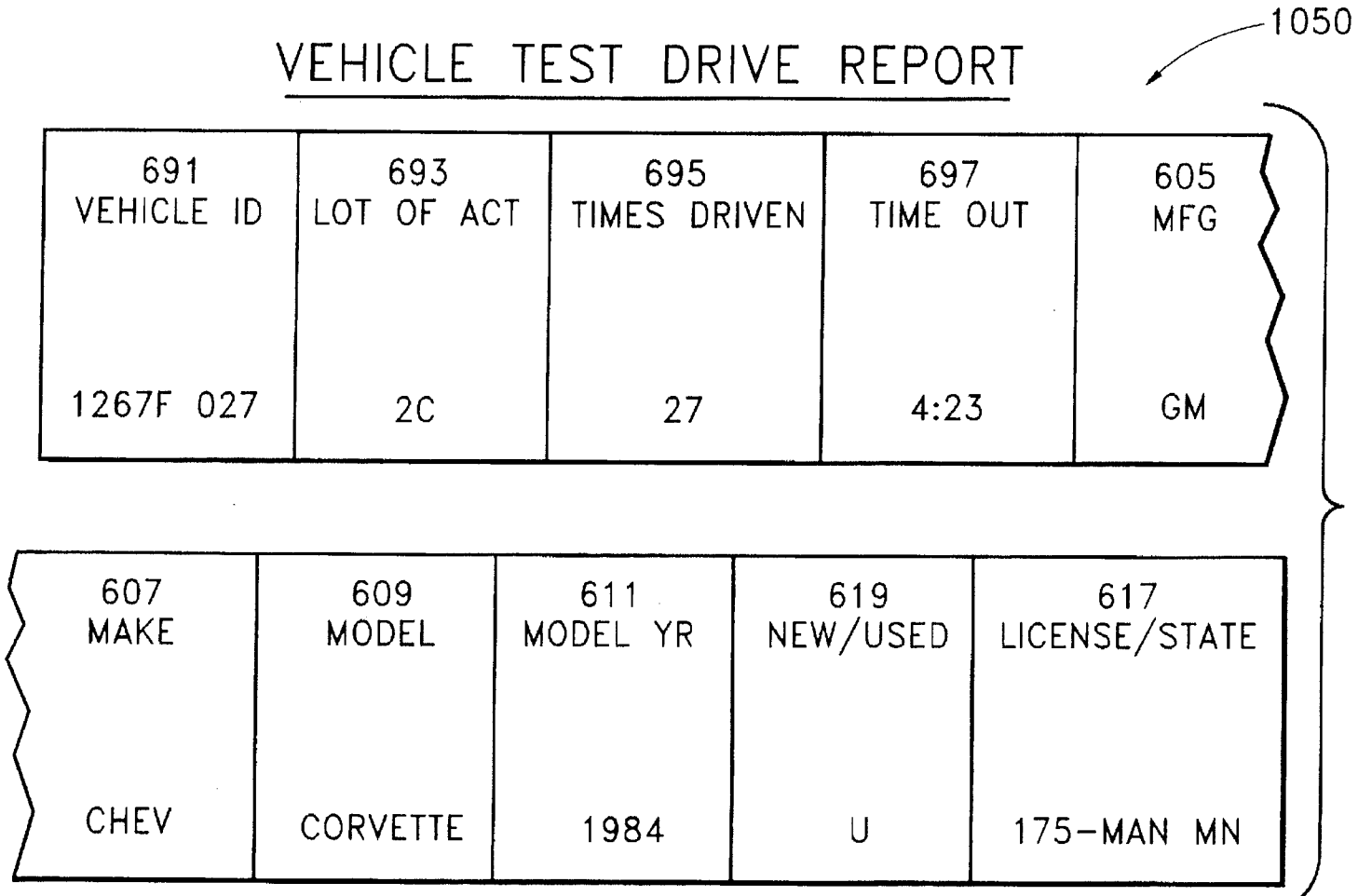
FIG. 10B is a block diagram of the preferred embodiment of the Vehicle Test Drive Report.

FIG. 10B contains the layout of the "Vehicle Test Drive Report" (1050) used to determine customer preference of dealer owned vehicles based on Number of Times Driven (695) or Time Out of Lot (697).

Given this disclosure one skilled in the art could develop other equivalent embodiments that are within the contemplation of the inventors.

We claim:

1. A system for monitoring vehicles passing through an area access to a vehicle storage area comprising:

one or more vehicle storage areas each with one or more area accesses, each area access having a base station antenna electrically connected to a base station;

one or more vehicles with a radio frequency tag attached, the radio frequency tag having a tag antenna, a tag radio frequency section, and a tag memory, the tag memory having vehicle ID information about the vehicle to which the radio frequency tag is attached;

one of more of the vehicles being a passing vehicle passing through one of the area accesses while a radio frequency signal is communicating between the base station and the radio frequency tag through the base station antenna and the radio frequency tag antenna respectively, and the tag radio frequency section placing the vehicle ID information on a return radio frequency signal sent to the base station;

one or more computers having status information in a computer memory, the status information including ownership information about the passing vehicle that is associated with the vehicle ID information, the status information further including other information; and an algorithm, executed by the computer, that uses the ownership information about the passing vehicle and the other status information to perform a specified action.

2. A system, as in claim 1, where the ownership information indicates that the passing vehicle is not owned by a dealership and the other information indicates an area identification of the vehicle storage area and one or more area times, the algorithm determining that the passing vehicle is not authorized to leave the storage area at one or more of the area times.

3. A system, as in claim 1, where the ownership information indicates that the passing vehicle is not owned by a dealership, the other information is maintenance information that indicates that the passing vehicle is unauthorized because the dealership has not completed the predetermined servicing for the passing vehicle and the specified action is a message is sent to a manager.

4. A system, as in claim 3, where the message is an alphanumeric page sent to the manager, the page providing information identifying the passing vehicle.

5. A system, as in claim 1, where the ownership information indicates that the passing vehicle is not owned by a dealership, the other information includes billing information, the algorithm determines that the vehicle is unauthorized because a service bill has not been paid and the specified action is a message sent to a computer terminal.

6. A system, as in claim 5, where the specified action is a page sent to a manager.

7. A system, as in claim 1, where the ownership information indicates the passing vehicle is owned by a dealership and the other information includes storage area information that indicates that the storage area is closed.

8. A system, as in claim 7, where the algorithm determines the passing vehicle is being stolen and the specified action is a message sent to a computer terminal.

9. A system, as in claim 7, where the algorithm determines the passing vehicle is being stolen and the specified action is a page sent to a manager.

10. A system, as in claim 1, where the ownership information indicates the vehicle is owned by a dealership and the other information indicates that dealership is open.

11. A system, as in claim 10, where the other information further indicates an amount of time the passing vehicle is out of the storage area and the amount of time is recorded.

12. A system, as in claim 11, where the computer algorithm periodically checks the amount of time to see if the time the passing vehicle has been out of the storage area exceeds a storage area time parameter.

13. A system, as in claim 12, where the specified action is a message sent to a computer terminal when the amount of time exceeds the storage area time parameter.

14. A system, as in claim 12, where the specified action is a page sent to a manager when the time the vehicle has been out exceeds the storage area time parameter.

15. A system, as in claim 11, where the computer algorithm tracks the amount of time the passing vehicle has been out of the vehicle lot.

16. A system, as in claim 10, where the computer algorithm keeps track of the number of times one or more of the passing vehicles has been taken for a test drive.

17. A system, as in claim 10, where the algorithm generates a marketing report indicating customer preference.

18. A system, as in claim 17, where the marketing report is based on the amount of time the passing vehicle was out of the storage area.

19. A system, as in claim 17, where the marketing report is based on the number of times a vehicle passed through one of the area accesses.

20. A system, as in claim 1, where the ownership information indicates that the passing vehicle is not owned by a dealership, the other information includes a service history for the vehicle, the algorithm determines from the other information that the passing vehicle needs service and the specified action is a message sent to a computer terminal indicating that the passing vehicle needs service.

21. A system, as in claim 1, where the ownership information indicates that the passing vehicle is not owned by a dealership the other information includes service information, the algorithm determines from the other information that the passing vehicle needs service and the specified action is a page sent to a manager indicating that the passing vehicle needs service.

22. A system, as in claim 1, where the status information is sent from a remote computer in a remote location.

23. A system, as in claim 22, where the status information is a service record of the passing vehicle.

24. A system, as in claim 1, where the ownership information indicates that the passing vehicle is not owned by a dealership, the other information is a service record of the passing vehicle and the specified action is to send a communication from the base station that writes the service record on the tag memory.

25. A system, as in claim 1, where the ownership information indicates that the passing vehicle is not owned by a dealership and tag memory also has a service record about the passing vehicle in the tag memory, the tag radio frequency section also places the service record on the return radio frequency signal.

26. A system, as in claim 25, where the algorithm uses the vehicle ID information and the service record to take the specified action of indicating that the vehicle needs service.

27. A system for monitoring cars passing through an entrance to a car dealership car lot comprising:

one or more car lots each with one or more entrances, each entrance having a base station antenna electrically connected to a base station;

one or more cars with a radio frequency tag attached, the radio frequency tag having a tag antenna, a tag radio frequency section, and a tag memory, the tag memory having car ID information, including a VIN (vehicle identification number), about the car to which the radio frequency tag is attached;

one or more of the cars being a passing car that passes through the entrance while a radio frequency signal communicates between the base station and the radio frequency tag through the associated base station antenna and the radio frequency tag antenna respectively, the tag radio frequency section placing the vehicle ID information on a return radio frequency signal sent to the base station when the passing car passes through the entrance;

one or more computers having status information, the status information including car ownership information about the passing car that is associated with the VIN the status information further including other car information; and an algorithm, executed by the computer, that uses the car ownership information of the passing car and the other car information to take an action.

28. A system, as in claim 27, where one of the computers is a central computer and the algorithm determines from the car ownership information that a car is not owned by the dealership.

29. A system, as in claim 28, where the computer algorithm records vehicle, customer lot, and a time the pressing vehicle enters and leaves the car lot.

30. A system, as in claim 29, where the VIN is used to generate a marketing report identifying a potential car buyer.

31. A system for monitoring vehicles passing through an area access to a vehicle storage area comprising:

one or more vehicle storage areas means for storing vehicles each with one or more area accesses means, each area access means having a base station antenna means electrically connected to a base station means;

one or more vehicles means with an radio frequency tag means attached, the radio frequency tag means having a tag antenna, a tag radio frequency section, and a tag memory, the tag memory having vehicle information about the vehicle means to which the radio frequency tag is attached;

one or more of the vehicle(s) means being a passing vehicle that passes through the area access while a radio frequency signal communicating between the base station means and the radio frequency tag means through the associated base station antenna means and the radio frequency tag antenna means respectively, the tag radio frequency section placing the vehicle information on a return radio frequency signal sent to the base station when the passing vehicle means passes through the access area;

one or more computer means having status information, the status information including ownership information about the passing vehicle that is associated with the vehicle ID information, the status information further including other information; and an algorithm means, executed by the computer means, that uses the ownership information of the passing vehicle means and the other information to take an action.

32. A method for for monitoring vehicles passing through an area access to a vehicle storage area comprising the steps of:

storing one or more vehicle storage areas each vehicle storage area having one or more area accesses, each area access having a base station antenna electrically connected to a base station;

attaching a radio frequency signal to one or more vehicles, the radio frequency tag having a tag antenna, a tag radio frequency section, and a tag memory, the tag memory having vehicle ID information about the vehicle to which the radio frequency tag is attached;

passing one or more passing vehicles through the area access while communicating a radio frequency signal between the base station and the radio frequency tag through the associated base station antenna and the radio frequency tag antenna respectively, the tag radio frequency section placing the vehicle ID information on a return radio frequency signal sent to the base station when the passing vehicle passes through the access area;

storing status information on one or more computers, the status information including ownership information about the passing vehicle that is associated with the vehicle ID information, the status information further including other information; and executing an algorithm by the computer, the algorithm using the vehicle ID information of the passing vehicle, the ownership information and the other information to take an action.

* * * * *